US009409183B2

(12) United States Patent
Kean et al.

(10) Patent No.: US 9,409,183 B2
(45) Date of Patent: Aug. 9, 2016

(54) PUMP AND SUBMERSIBLE SOLIDS PROCESSING ARRANGEMENT

(71) Applicant: Weir Minerals Australia, Ltd., Artarmon NSW (AU)

(72) Inventors: Jamie W. Kean, Macungie, PA (US); Gary Saylor, Sugarloaf, PA (US); David P. Nevin, Breinigsville, PA (US); Michael Hill, Hazleton, PA (US)

(73) Assignee: Weir Minerals Australia, Ltd. (AU)

( * ) Notice: Subject to any disclaimer, the term of this patent is extended or adjusted under 35 U.S.C. 154(b) by 659 days.

(21) Appl. No.: 13/720,813

(22) Filed: Dec. 19, 2012

(65) Prior Publication Data

US 2014/0027546 A1 Jan. 30, 2014

Related U.S. Application Data

(60) Provisional application No. 61/677,359, filed on Jul. 30, 2012, provisional application No. 61/703,014, filed on Sep. 19, 2012.

(51) Int. Cl.
*B02C 23/00* (2006.01)
*B02C 23/02* (2006.01)
(Continued)

(52) U.S. Cl.
CPC ..... *B02C 23/00* (2013.01); *B02C 23/02* (2013.01); *B02C 23/36* (2013.01); *F04D 7/045* (2013.01); *F04D 13/086* (2013.01)

(58) Field of Classification Search
CPC ..... B02C 23/00; B02C 23/02; B02C 23/36; B02C 18/0092; F04D 13/086; F04D 7/045; F04D 1/02; F04D 29/2288; F04D 7/04; F04D 29/04; F04D 29/10; F04B 53/00; E02F 3/8841; E02F 3/9225; F16J 15/50; F16J 15/54
See application file for complete search history.

(56) References Cited

U.S. PATENT DOCUMENTS 805,965 A * 11/1905 Jones ..... E02F 3/9231 37/325
3,444,818 A 5/1969 Sutton
(Continued)

FOREIGN PATENT DOCUMENTS

CA 2288230 A1 4/2001
GB 2298679 A 9/1996
(Continued)

OTHER PUBLICATIONS

Machine translation for JP 2003-074487, "Submerged Pump".*
(Continued)

*Primary Examiner* — Alexander P Taousakis
*Assistant Examiner* — Leonel Vasquez
(74) *Attorney, Agent, or Firm* — Morriss O'Bryant Compagni

(57) ABSTRACT

A pump and submersible solids processing arrangement includes a pump, having a suction inlet and discharge, and a submersible solids processing arrangement positioned in fluid communication with the suction inlet of the pump and being structured to macerate larger solids and matter that is entrained in a fluid to thereby reduce the size of the solids prior to entry of the fluid and solids into the inlet of the pump, the arrangement further including macerating members the speed and arrangement of which are selectively determinable or adjustable, and the arrangement further comprising an agitator arrangement for directing solids into the submersible solids processing arrangement.

20 Claims, 16 Drawing Sheets

(51) Int. Cl.

| | |
|---|---|
| ***B02C 23/36*** | (2006.01) |
| ***F04D 7/04*** | (2006.01) |
| ***F04D 13/08*** | (2006.01) |

(56) References Cited

U.S. PATENT DOCUMENTS 3,596,444 A * 8/1971 Beattie ..... A01D 44/00 56/379
4,170,079 A * 10/1979 Holekamp ..... E02F 3/905 37/318
4,347,032 A 8/1982 Possell
4,560,476 A 12/1985 Nishimori
4,640,666 A 2/1987 Sodergard
4,697,746 A 10/1987 Nishimori
4,904,159 A * 2/1990 Wickoren ..... F04D 7/045 415/121.1
4,911,368 A 3/1990 Nishimori
4,961,540 A * 10/1990 Wiesemann ..... B02C 18/142 241/236
6,241,470 B1 * 6/2001 Oakley ..... F04D 7/045 415/121.1
6,551,054 B1 * 4/2003 Peltonen ..... D21D 5/26 415/1
6,843,003 B2 * 1/2005 Araoka ..... E02F 3/9212 37/317
6,938,845 B2 * 9/2005 Galanty ..... B02C 18/0092 241/166
6,951,445 B2 10/2005 Burgess
7,011,749 B2 * 3/2006 Hayes ..... B09C 1/08 210/170.04
7,178,749 B2 2/2007 Parrett et al.
7,556,214 B2 7/2009 Parrett et al.
7,607,884 B2 * 10/2009 Cohen ..... F04D 29/126 415/111
7,878,218 B2 * 2/2011 Ivan ..... B01D 21/2461 137/899

FOREIGN PATENT DOCUMENTS

JP 07003837 A * 1/1995 ..... E02F 3/92
JP 200374487 A 3/2003

OTHER PUBLICATIONS

Machine translation for 07-003837, “Dredging Equipment”.*

* cited by examiner

PUMP AND SUBMERSIBLE SOLIDS PROCESSING ARRANGEMENT

CROSS-REFERENCE TO RELATED APPLICATION

This application is a non-provisional application claiming priority to provisional application Ser. No. 61/677,359, filed Jul. 30, 2012, and also claiming priority to provisional application Ser. No. 61/703,014, filed Sep. 19, 2012, the contents of both applications of which are incorporated herein in their entirety.

TECHNICAL FIELD

This disclosure relates, in general, to industrial pumps and, in particular, to improved pump and solids handling assemblies and methods for processing larger solids components in fluids to produce smaller sized solids to thereby facilitate the pumping of fluids having entrained solids.

BACKGROUND OF THE DISCLOSURE

In many industries where a fluid is to be pumped from a well, sump or other body of fluid, such as a settling pond, the fluids contain particulate matter, and centrifugal-slurry pumps are commonly used to process such fluids to remove the fluid and solids from the well, sump or body of fluid. In many industries, such as the mining industry for example, the particulate solids are of a relatively smaller size and the slurry pump that is used in the application is particularly selected for its ability to process the type and size of solids that are entrained in the fluid as a result of the mining operations.

In other industries, however, the fluid to be pumped contains larger solids or debris that, when pumped using conventional slurry pump arrangements, will clog the impeller or other pump structures and will cause the pump to become damaged or to seize. One such example is in the processing of mature fine tailings (MFT) in which a mixture of water, clay, sand and residual hydrocarbons that are produced during mine extraction are pumped into settling ponds that can be quite massive, and possibly several kilometers in width. Such settling ponds are produced to allow heavier particulates, such as sand, to settle to the bottom while water settles at the top of the pond. It is desirable, if not required by law, to remove the MFT in order to return the land to its previous state after the mining operations have ended It is frequently the case that settling ponds are established on lands that were formerly covered with vegetation, including large trees. Therefore, subsequent pumping of the MFT from settling ponds results in encountering large solids of vegetation (e.g., tree stumps and branches), as well as other objects that might have been discarded into the pond. Thus, the pumping of sand and larger solids from settling ponds is particularly challenging to many centrifugal pumps, and ultimately causes them to fail. The pumping operation must then be stopped and the pump, if submerged in the fluid, must be lifted out of the sump or well to allow for repair or replacement of the pump, all of which results in costly operational down-time and loss of equipment.

It would be beneficial, therefore, to provide a pumping assembly that is structured to process large solids and fluid-entrained debris into smaller sized matter before entering into the pump to avoid damaging the pump.

SUMMARY

In a first aspect of the disclosure, embodiments are disclosed of a pump and submersible solids processing arrangement comprising a pump having a casing, an inlet and a discharge outlet, and a submersible solids processing arrangement positioned in fluid communication with the inlet of the pump and being structured to macerate solids entrained in a fluid prior to entry of the fluid and solids into the inlet of the pump, the submersible solids processing arrangement comprising a plurality of macerating members that are arranged about a center point of the submersible solids processing arrangement. The first aspect of the disclosure provides an advantage over conventional submersible solids processing arrangements in providing improved means for processing, or macerating, larger solids that are entrained in the fluid prior to the point of entry of the fluid and solids into the suction inlet of the pump, thereby avoiding clogging of the impeller or other internal pump parts by large solids that are large enough to enter the inlet of the pump, but not small enough to pass through the impeller or other structural elements of the pump without causing an obstruction or without becoming lodged in the pump.

As used in the disclosure and in the claims, "macerate", "macerating" and "chopping" are used in a general and descriptive sense to mean that the solids entrained in a fluid are reduced to smaller pieces by some action including, but not limited to, cutting, chopping, slicing, tearing, crushing and/or grinding, and the terms "macerate", "macerating" and "chopping" are not intended to be limited to their conventional dictionary definition or to any one of the enumerated actions that may operate, by the structures of the embodiments described herein, to reduce the size of a larger solid into smaller sizes of solid matter. Nor are the terms "macerate" or "macerating" meant to strictly imply that solids are liquefied, though liquefaction may occur.

In certain embodiments, the pump is a submersible pump.

In certain further embodiments, the inlet of the submersible pump is attached to the submersible solid processing arrangement.

In other embodiments, the pump is located at a distance from the submersible solids processing arrangement, and the pump is in fluid communication with the submersible solids processing arrangement via a length of conduit that is secured at one end to the inlet of the pump and secured at the other end to the submersible solids processing arrangement.

In certain embodiments, the pump is a rotodynamic pump having an impeller.

In certain embodiments, the center point of the submersible solids processing arrangement is parallel to a rotational axis of the impeller of the pump.

In yet other embodiments, the center point of the submersible solids processing arrangement is co-extensive with the rotational axis of the impeller.

In certain embodiments, the macerating members are each structured with a central axis, and some or all of the macerating members rotate about their respective central axis.

In other embodiments, certain of the macerating members rotate in a defined direction, and certain of the macerating members rotate in the opposite direction to the defined direction.

In yet other embodiments, the plurality of macerating members is arranged such that every other macerating member of the plurality of macerating members rotates in the same direction.

In one certain embodiment, the plurality of macerating members comprises six rotatable macerating members arranged to encircle the center point of the submersible solids processing arrangement, and a first group of three of the macerating members are spaced apart from each other and rotate in one direction, and the second group of three macerating members are each positioned between a pair of macerating members of the first group, the macerating members of the second group being rotatable in a direction opposite to the direction of rotation of the first group of macerating members.

In still another embodiment, the macerating members of one of said first group or said second group are fixed relative to the center point, and the macerating members of the other of said first or second group are structured to be radially adjustable relative to the center point.

In certain embodiments, the rotational direction of any macerating member can be selected through drive means attached to each macerating member.

In other certain embodiments, each macerating member is attached to a drive means, and the direction of rotation of any macerating member can be reversed to cause the macerating member to change direction of rotation.

In yet another embodiment, the drive means for effecting rotation of each macerating member is a hydraulic motor.

In yet other embodiments, the drive means of each macerating member is centrally controlled and monitored.

In still another embodiment, the macerating members are caused to rotate by suction pressure created by the pump.

In another embodiment of this aspect, the speed of rotation of each macerating member is the same.

In yet other embodiments, the speed of rotation of any macerating member may be selectively varied from the speed of rotation of another macerating member.

In certain embodiments, some or all of the macerating members are radially adjustable relative to the center point of the submersible solids processing arrangement so that each radially adjustable macerating member may be adjusted closer to or farther from the center point of the submersible solids processing arrangement.

In other certain embodiments, some or all of the macerating members are axially adjustably in a direction substantially parallel to a longitudinal axis extending through the center point of the submersible solids processing arrangement.

In other embodiments, each macerating member is structured with a plurality of macerating elements arranged along the macerating member such that macerating elements of one macerating member effect a cutting action with macerating elements of an adjacently positioned macerating member.

In still other embodiments, the macerating elements are axially adjustable in a direction along the central axis of the macerating member.

In yet another embodiment, the macerating elements are radially adjustable to position the macerating elements closer to or farther from the central axis of the macerating member.

In certain other embodiments, the macerating elements are formed as ring-like elements that extend outwardly from a surface of each macerating member and are positioned to intermesh with ring-like macerating elements of adjacently positioned macerating members.

In yet other embodiments, each macerating member of the plurality of macerating members has a central axis, and the central axis of each macerating member is parallel to a longitudinal line extending through the center point of the submersible solids processing arrangement.

In still other embodiments, each macerating member of the plurality of macerating members has a central axis, and the central axis of each macerating member is other than parallel to a longitudinal line extending through the center point of the submersible solids processing arrangement.

In certain embodiments, the submersible solids processing arrangement further comprises a support frame to which the pump is attached to provide fluid communication between the pump and the solids processing arrangement.

In certain other embodiments the support frame further comprises a first platform to which the inlet of the pump is attached in fluid communication therewith, and a second platform that is spaced from the first platform, and the macerating members are positioned between the first platform and second platform.

In certain embodiments, the submersible solids processing arrangement further comprises an agitator arrangement comprising at least one agitator positioned in proximity to the macerating members to direct flow of agitated fluid and solids to the macerating members of the solids processing arrangement.

In certain other embodiments, the agitator arrangement further comprises an arrangement of arms operatively connected to a motor to impart rotation to the arrangement of arms.

In yet other embodiments, the arms of the arrangement of arms are each secured in proximity to the motor in a manner that allows the arms to pivot, relative to the motor, in a plane that extends parallel to a plane in which a longitudinal line extending through the center point of the submersible solids processing arrangement lies.

In certain embodiments, the agitator arrangement comprises at least one sparger.

In still other embodiments, the pump and submersible solids arrangement further comprises at least one vertically-oriented blade positioned adjacent the arrangement of macerating members and spaced away from the center point of the submersible solids processing arrangement, the at least one vertically-oriented blade being positioned in proximity to the macerating elements of the macerating members to facilitate removal of solids matter from the macerating members.

In certain embodiments, the pump further comprises a bearing housing attached to the pump casing at a point opposite the suction inlet, and a pump shaft which extends through the bearing housing and the pump casing to be operatively connected to an impeller, the pump being further configured with a cylindrical cartridge seal arrangement surrounding the pump shaft and being positioned between the bearing housing and pump casing to seal the pump shaft from the pump casing, the cylindrical cartridge seal arrangement comprising a series of lip seals and deflectors positioned adjacent each lip seal, a slinger device and a centrally positioned lubrication port positioned to introduce a lubricant to the series of lip seals.

In a second aspect of the disclosure, a submersible solids processing arrangement comprises a plurality of macerating members arranged about a center point defining a flow direction along which macerated solids and fluid are directed toward a pump inlet. The second aspect of the disclosure provides an advantage over conventional submersible solids processing arrangements in providing improved means for processing solids that are entrained in a fluid into smaller sized matter that can then be directed toward a flow direction that delivers the fluid and processed solids to a pump, thereby relieving potential clogging problems in the pump.

In a third aspect of the disclosure, a seal arrangement for sealing the pump shaft of a pump comprises a rotating seal having a seal face, a stationary seal having a seal face positioned adjacent to and in contact with the seal face of the rotating seal, a gland housing configured to surround a pump shaft and positioned to support the stationary seal, a plurality of lip seals positioned serially within the gland housing and a plurality of deflectors, one deflector being positioned adjacent each lip seal of said plurality of lip seals. The third aspect of the disclosure provides an advantage over conventional sealing arrangements by providing an arrangement of lip seals and deflectors that more effectively prevent slurry from entering into the seal arrangement and infiltrating the seal faces.

In certain embodiments of the sealing arrangement, a slinger device is further positioned adjacent the gland housing and is operative to deflect fluid and solids in a direction away from the gland housing.

In a fourth aspect of the disclosure, a method of processing and pumping solids-entrained fluid involves:

providing a pump and submersible solids processing arrangement, comprising:

a pump having a casing, a suction inlet and a discharge outlet, and a submersible solids processing arrangement in fluid communication with the suction inlet of the pump and being structured to process into smaller sized matter solids that are entrained in a fluid prior to entry of the fluid into the suction inlet of the pump;

positioning the pump in proximity to a source of fluid having entrained solids;

creating suction at said suction inlet of the pump thereby drawing fluid and the entrained solids into the submersible solids processing arrangement positioned in a body of fluid;

operating the submersible solids processing arrangement to effect maceration of the solids entrained in the fluid as the fluid passes through the submersible solids processing arrangement and into the suction inlet of the pump; and moving the fluid and macerated solids entrained in the fluid through the pump to the discharge outlet of the pump.

The methods of this fourth aspect provide improved means for processing large solids that are entrained in a fluid to reduce the solids to smaller sizes, prior to reaching the suction inlet of the pump, to thereby prevent damage to the impeller and the pump arising from large-sized debris being lodged in the impeller or other structural elements of the pump.

In certain embodiments, the submersible solids processing arrangement comprises a plurality of macerating members positioned about a center point of the submersible solids processing arrangement.

In certain other embodiments, the macerating members are structured to be rotatable about a central axis of the macerating member, and fluid and solids are drawn into the arrangement of macerating members in a direction perpendicular to a flow direction defined by a longitudinal line extending through the center point of the submersible solids processing arrangement.

In yet other embodiments, the macerating members are structured with a plurality of macerating elements that are oriented to mesh with macerating elements of adjacently positioned macerating members to effect maceration of solids entrained in the fluid.

Other aspects, features, and advantages will become apparent from the following detailed description when taken in conjunction with the accompanying drawings, which are a part of this disclosure and which illustrate, by way of example, principles of the various aspects of the embodiments of the disclosure.

DESCRIPTION OF THE FIGURES

The accompanying drawings facilitate an understanding of the various embodiments, in which.

DETAILED DESCRIPTION

The pump and submersible solids processing arrangement of the disclosure is structured to process solids that are entrained in fluid so that the solids can be passed into and through the pump for discharge from the pump. The pump and submersible solids processing arrangement can be adapted to any number of applications in any number of industries and, therefore, the specific elements of the pump and submersible solids processing arrangement may be selected for the particular application and the conditions under which the pump and submersible solids processing arrangement are employed. Consequently, while the elements of the pump and submersible solids processing arrangement are generally described and illustrated herein with respect to a submersible centrifugal pump and submersible solids processing assembly by way of example only, it is to be understood that the scope of this disclosure is not to be limited to the specific elements described and illustrated herein since many modifications are possible within the scope of the disclosure as defined by the claims.

Figure 1:
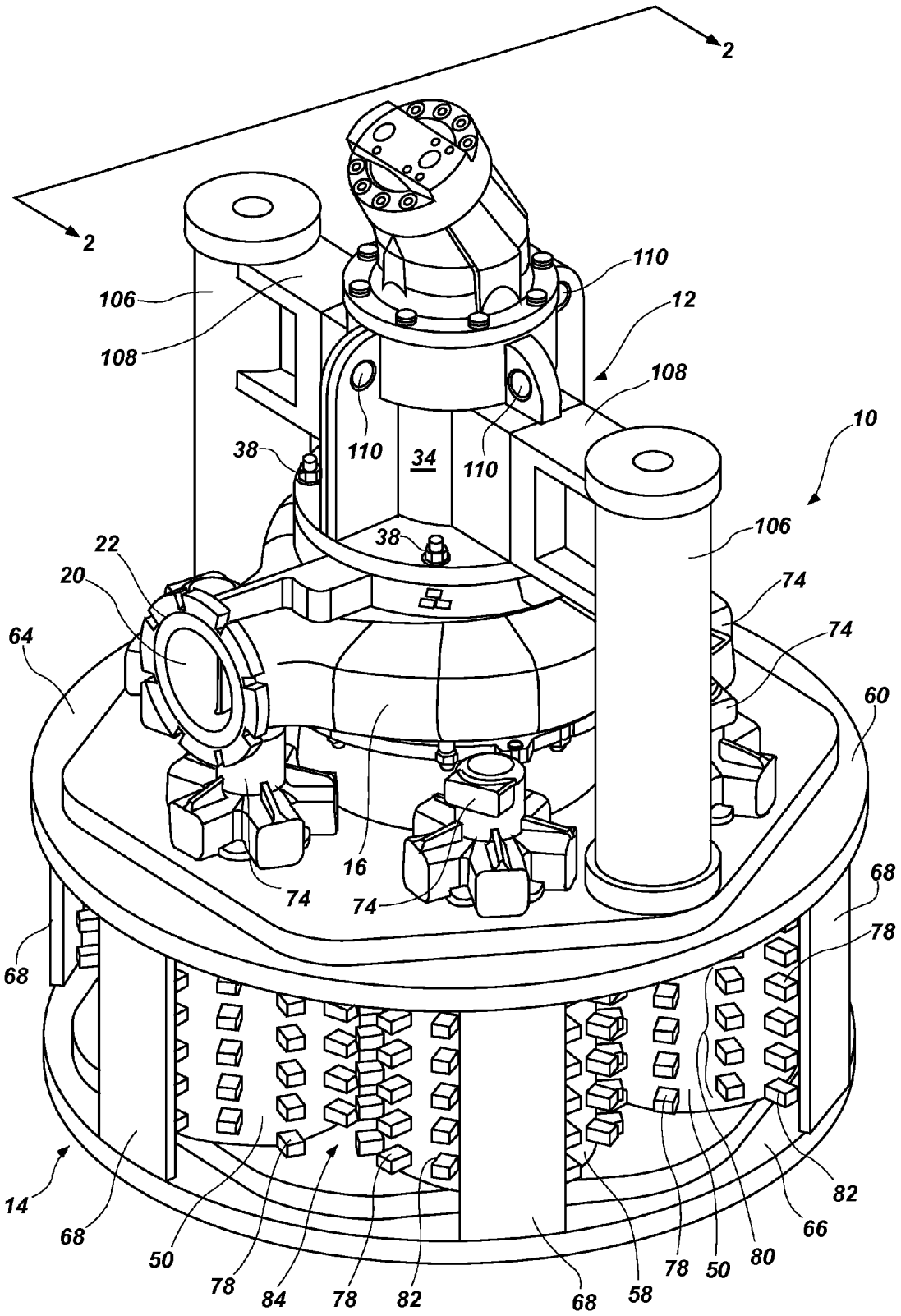
FIG. 1 is an isometric perspective view of a first aspect of a pump and submersible solids processing arrangement in accordance with this disclosure.
Figure 2:
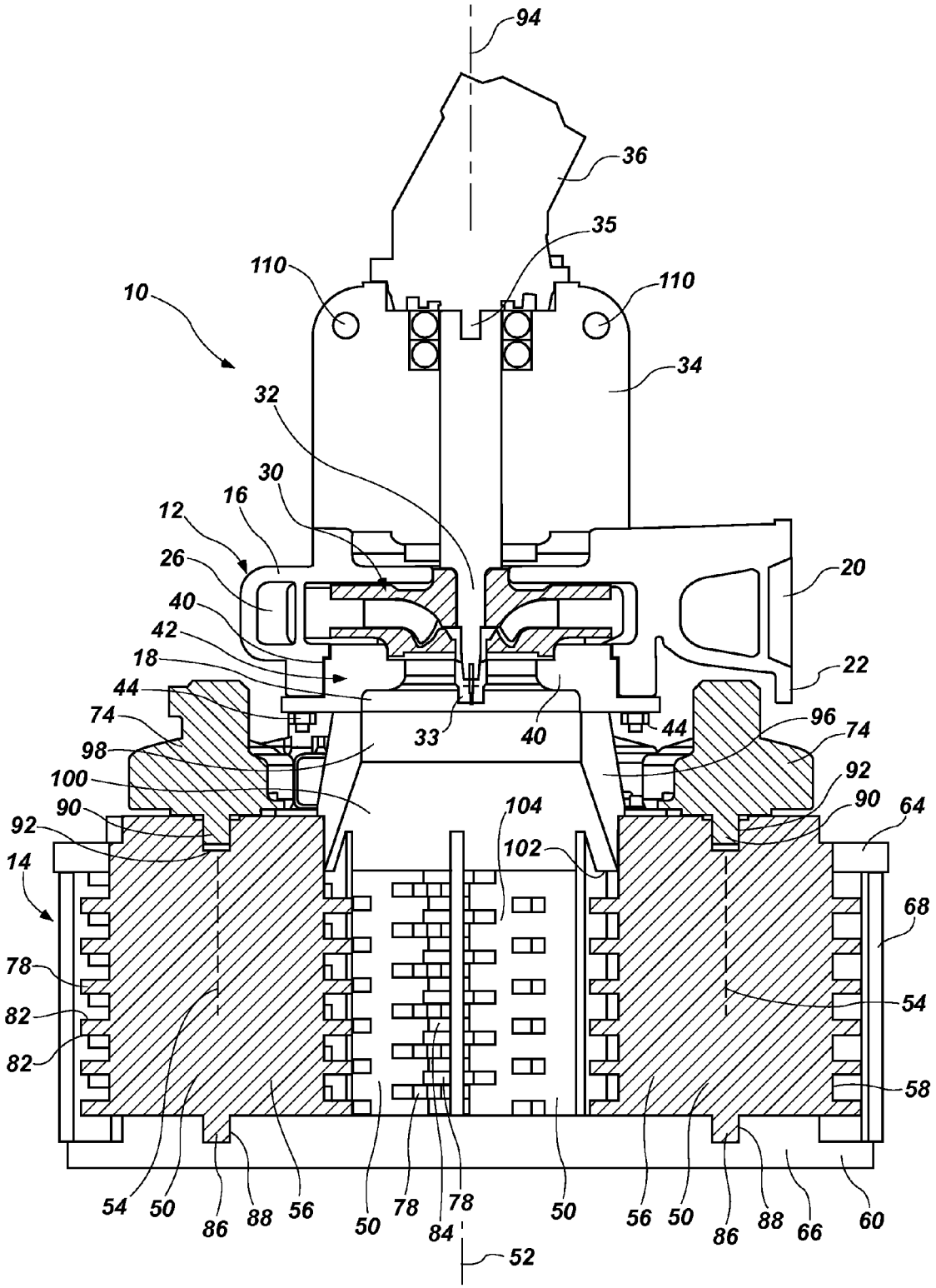
FIG. 2 is a view in elevation and in partial cross section of the pump and submersible solids processing arrangement shown in FIG. 1.

FIGS. 1 and 2 illustrate a first aspect of a pump and submersible solids processing arrangement 10 of the type that may be used in a sump, well or body of fluid to process and pump the fluid from the sump, well or body of fluid, especially fluid that has entrained therein larger sized solids or debris that cannot be processed by a pump without clogging or causing seizing of the pump.

The pump and submersible solids processing arrangement 10 generally comprises a pump 12 that is positioned in relationship to a body or source of fluid in which solids are entrained, and a submersible solids processing arrangement 14 for processing larger solids that are entrained within a fluid.

The pump 12 may generally be comprised of a casing 16, a suction inlet 18, as best seen in FIG. 2, and a discharge outlet 20. The discharge outlet 20 may be configured with a flange 22 to which piping (not shown) may be attached for carrying the pumped fluid to a higher elevation (e.g., ground level above the sump, well or body of fluid, etc.) or to a location away from the pump.

FIG. 2 depicts a centrifugal pump, the pump casing 16 of which is generally configured with a volute 26 in which an impeller 30 is positioned in known fashion. The impeller 30 is attached to a pump shaft 32 by means of an impeller nut 33, and the pump shaft 32 is, in turn, attached to a drive shaft 35 by known means. The drive shaft 35 is connected to a drive motor 36 which imparts rotation to the impeller 30. The impeller 30 may be of any type that is suited to the particular pumping application. For example, the impeller 30 may be of the closed, open, semi-open or recessed type, or any other suitable type or configuration. The pump shaft 32 extends through a bearing housing 34 to which the casing 16 of the pump 12 is attached by bolts 38, as best seen in FIG. 1.

Figure 8:
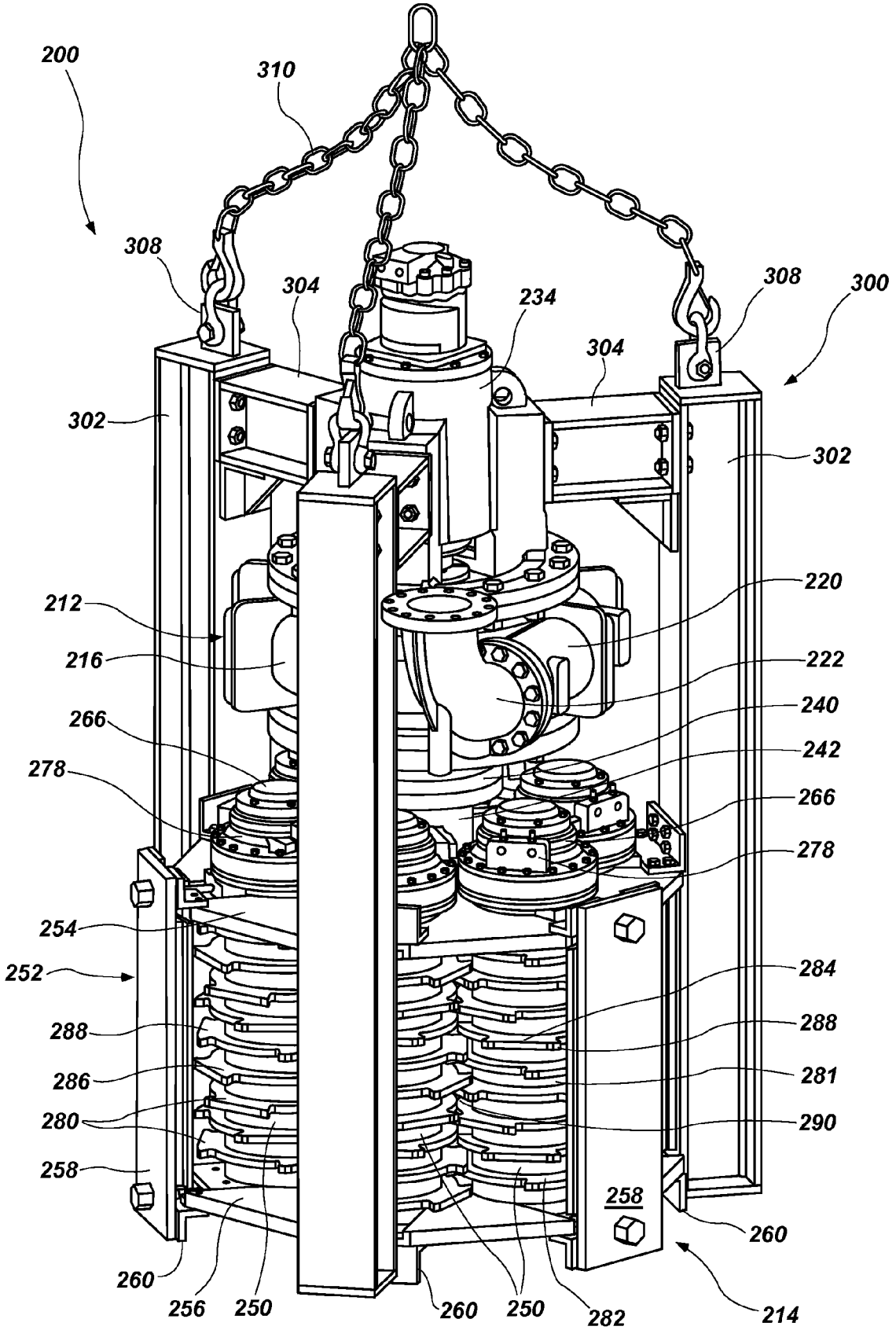
FIG. 8 is an isometric view of another embodiment of the pump and submersible solids processing arrangement.
Figure 10:
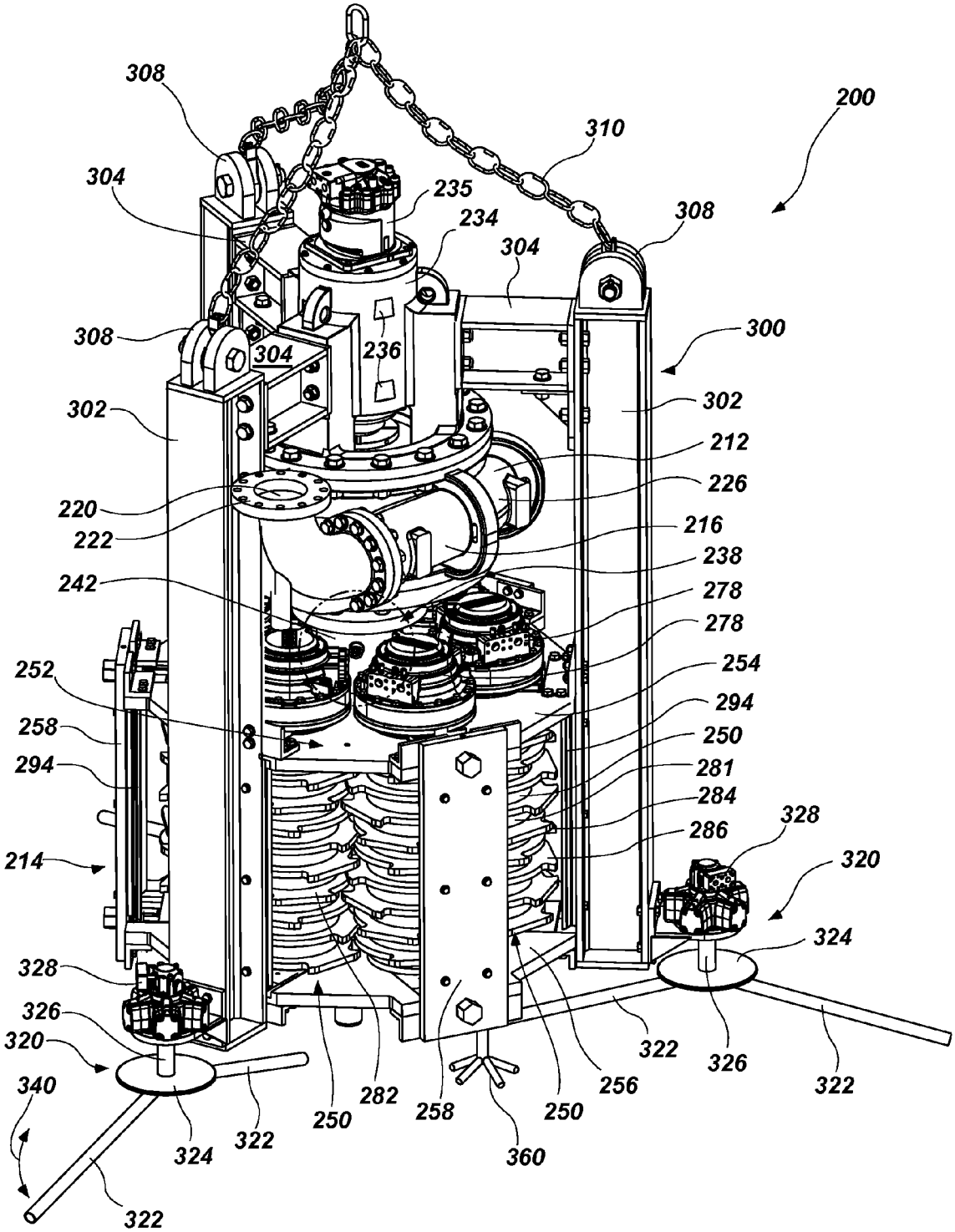
FIG. 10 is an isometric view of an alternative embodiment of a pump and solids processing arrangement in accordance with this disclosure.

It should be noted that in FIGS. 1, 8 and 10, a submersible centrifugal slurry pump is shown as the pumping means. However, other rotodynamic pumps of differing construction and type may be used in the pump and submersible solids processing arrangement 10 described in this disclosure. Other types of pumps, such as positive displacement pumps, may be used in the pump and submersible solids processing arrangement, and other types of pumps which are not submersible may also be used in the disclosed arrangement, as described further hereinafter. This disclosure is not intended to limit, and should not be interpreted to be limiting of, the type of pump that may be used in the disclosed arrangement. Nor should this disclosure be interpreted to limit the placement or positioning of the pump 12 relative to a body of fluid and/or limit the location or positioning of the pump relative to the solids processing arrangement 14. For example, the pump 12 depicted in the figures herein are shown to be in a generally vertical orientation. However, the pump may be oriented in horizontal adjacency to the submersible solids processing arrangement, and/or the pump may be a horizontally configured pump.

The pump and submersible solids processing arrangement 10 further includes a solids processing assembly 14 that is positioned in fluid communication with the suction inlet 18 of the pump 12. The solids processing assembly 14 is positioned with respect to a body of fluid to encounter the flow of fluid and solids as it moves or is directed toward the suction inlet 18 of the pump 12. The solids processing assembly 14 is structured to macerate the solids entrained in the fluid to effectively reduce the size of the solids so that the solids can be passed through the inlet 18, through the impeller 30 and through the volute 26 of the pump 12 without becoming lodged in the pump structures. The solids processing arrangement 14 may be structured and configured in any number of ways to effect a reduction in size of solids entrained in a body of fluid.

In general, the pump 12 is joined to the solids processing arrangement 14 in a manner that places the pump in fluid communication with the solids processing arrangement so that fluid and solids passing through the solids processing arrangement 14 are moved or directed toward the inlet 18 of the pump 12. In one aspect of the disclosure illustrated in FIGS. 1 and 2, the pump 12 is connected to the solids processing arrangement 14 by, for example, an inlet pathway 40 comprising an entry liner or throatbush 42 which is attached to the casing 16 of the pump 12 by bolts 44.

Figure 3:
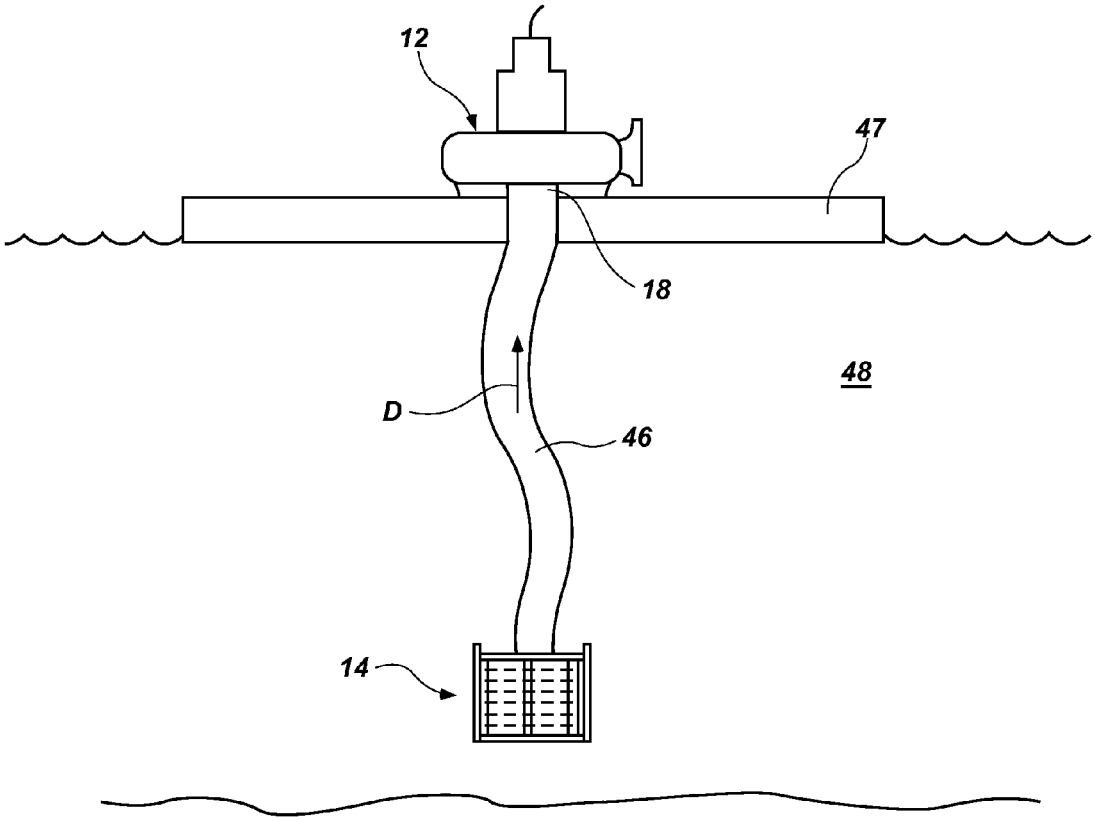
FIG. 3 is a schematic view of another aspect of the disclosure depicting the pump separated from the submersible solids arrangement by a length of conduit.

In another aspect of the disclosure depicted in FIG. 3, the inlet 18 of pump 12 is in fluid communication with the solids processing arrangement 14 by means of a conduit 46 of a selected length. In this aspect, the pump 12 is not submerged in the body of fluid, but is positioned on a support surface 47, such as a barge, that is positioned above, on or to the side of the body of fluid 48. Fluid and solids that are processed by the submersible solids processing arrangement 14 flow through the conduit 46 in a direction toward the inlet 18 of the pump 12. It may be said that the conduit 46 defines a flow direction D in which the fluid and macerated solids flow toward the inlet 18 of the pump 12 that is positioned on the support surface 47.

Figure 4:
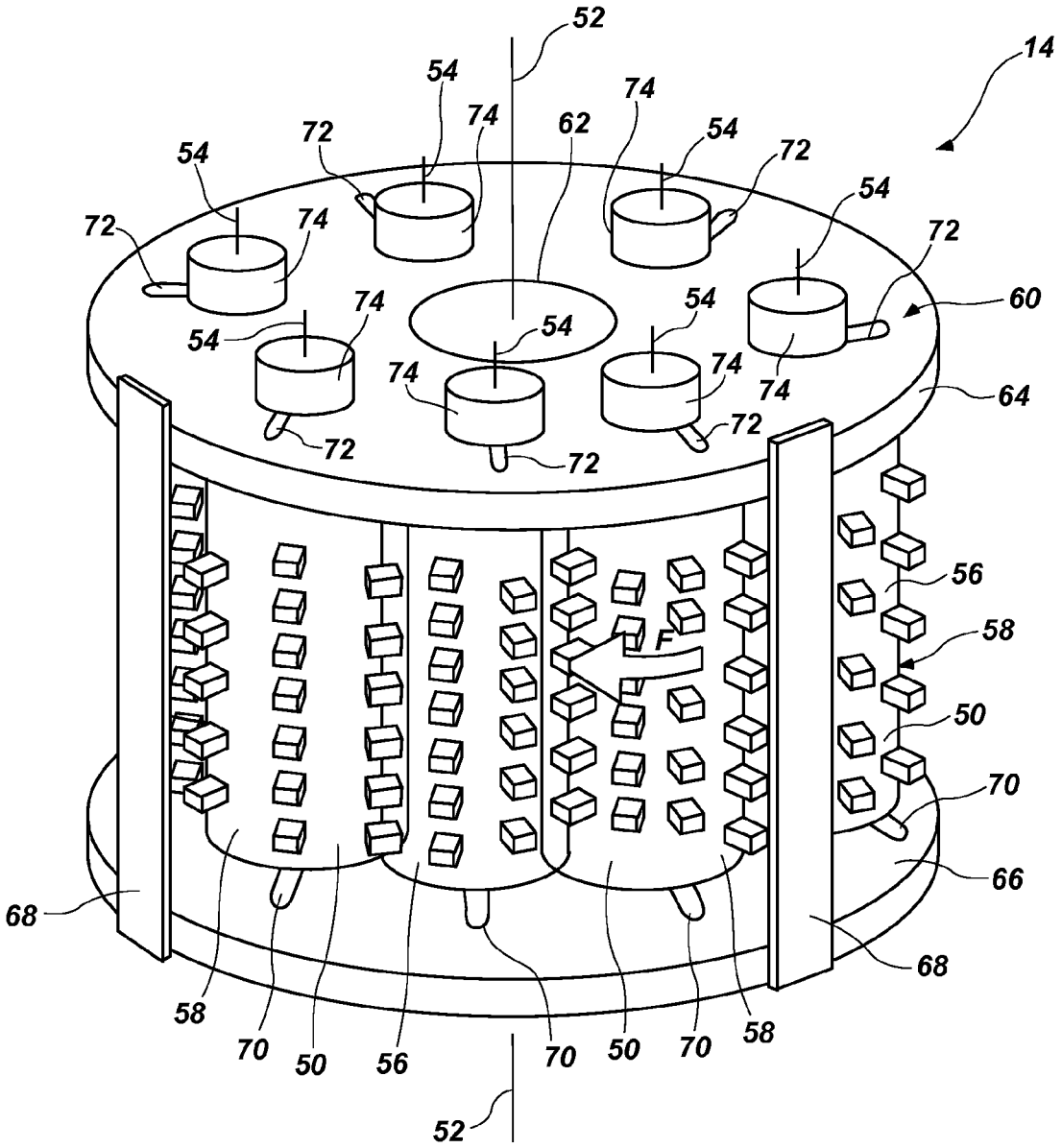
FIG. 4 is an isometric view of a submersible solids processing arrangement in accordance with the disclosure.

Referring to FIG. 4, the solids processing arrangement 14 of the disclosure is generally comprised of an assembly of elements that processes the solids entrained in a fluid by macerating the solids into small sizes, and directs the processed solids and fluid toward the inlet of the pump 12. The solids processing arrangement 14 principally comprises a plurality of macerating members 50 that are arranged to interact with fluid-entrained solids to provide maceration of the solids. The macerating members 50 are positioned to surround a center point 52 that generally defines a longitudinal axis of the submersible solids processing arrangement 14 and generally defines a flow pathway for fluid and solids that have been processed by the macerating members 50.

In some embodiments, described further hereafter, the longitudinal axis that defines the center point 52 extends through the suction inlet 18 of the pump 12, and may be co-extensive with the rotational axis of the impeller 30. In alternative embodiments of the disclosure, the longitudinal axis that defines the center point 52 may be parallel to, but not co-extensive with the rotational axis of the impeller 30. In still other embodiments, the longitudinal axis that defines the center point 52 of the submersible solids processing arrangement 14 may be generally parallel to the flow direction D (FIG. 3) of the flow of fluid and solids toward the inlet 18 of the pump 12, and may or may not be co-extensive with the flow direction D.

The macerating members 50 are each configured with a central axis 54. The central axis 54 may also be a rotational axis about which the macerating member 50 may rotate if so constructed. The central axis 54 of each macerating member 50 may, in one aspect of the invention, be oriented parallel to the center point 52 of the submersible solids processing arrangement 14, as depicted in FIG. 4, and fluid and solids entering between the macerating members is generally directed through the assembly of macerating members 50 is a direction F that is normal to the longitudinal axis that defines the center point 52 of the solids processing arrangement and/or the flow direction D of a conduit 46 (FIG. 3).

Figure 5:
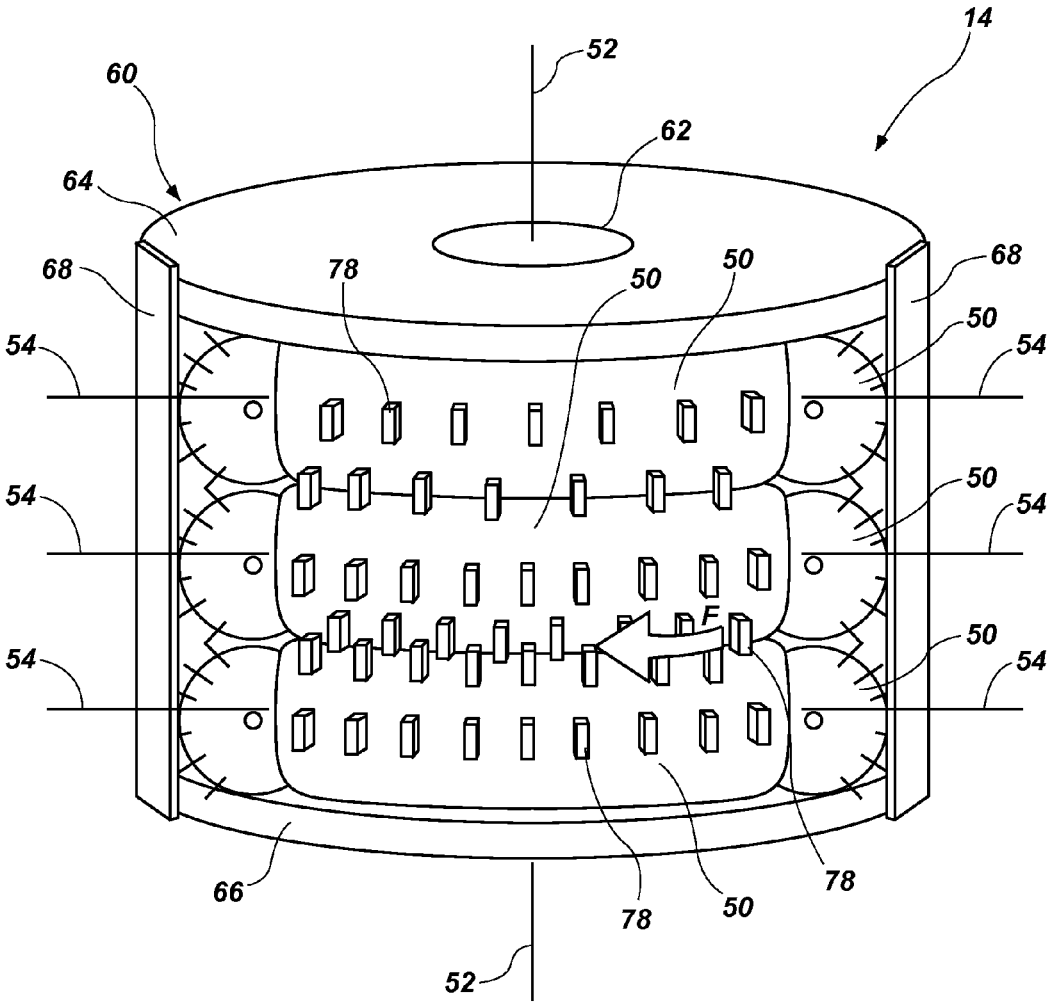
FIG. 5 an isometric view of an alternative embodiment of a submersible solids processing arrangement in accordance with the disclosure.

Alternatively, as depicted schematically in FIG. 5, the macerating members 50 may be arranged to surround the center point 52 of the submersible solids processing arrangement 14, but the central axis 54 of the macerating members are generally oriented normal to the longitudinal axis that defines the center point 52. Fluid and solids entering between the macerating members 50, as depicted in FIG. 5, are generally directed through the assembly of macerating members 50 in a direction F that is normal to the longitudinal axis that defines the center point 52 of the solids processing arrangement 14 and/or flow direction D (FIG. 3) of a conduit 46. The arrangement of the macerating members 50 around the center point 52, whether oriented as shown in FIG. 4 or FIG. 5, provides an improved mode of encountering and processing solids in a body of fluid by facilitating contact between the solids and the macerating members 50, and by providing an improved flow path of fluid and solids directed toward the inlet of the pump.

The number of macerating members 50 that are employed in the submersible solids processing arrangement 14 can number from two up to twenty or more. The number of macerating members 50 that are employed in the arrangement may ultimately be dictated by the type of fluid-entrained solids that are to being processed, and/or by the conditions of the application, such as location of the body of fluid or temperature conditions.

Figure 6:
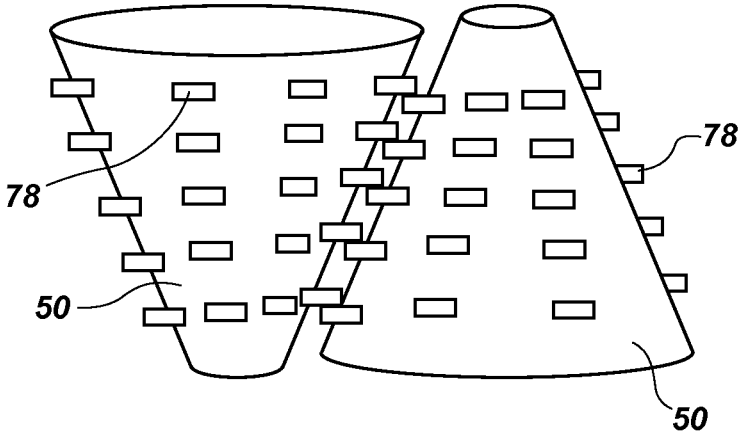
FIG. 6 is a schematic view of an alternative configuration of the macerating members.
Figure 7:
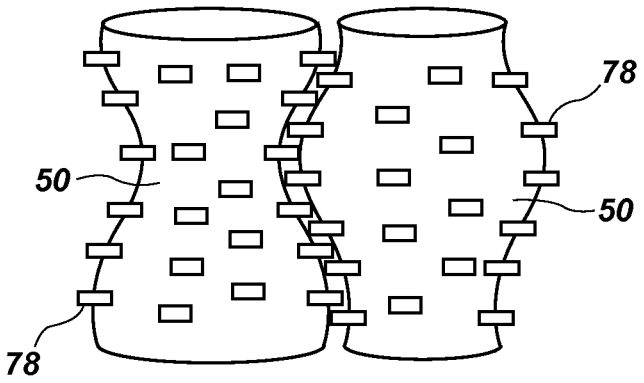
FIG. 7 is a schematic view of another alternative configuration of the macerating members.

The macerating members 50 may generally be configured as cylindrically-shaped and elongated drums 56 having a selected height and diameter, as depicted in FIG. 4. Alternatively, the macerating members may have any other suitable shape, configuration or geometry. For example, the macerating members, as shown in FIG. 6, may be conical in shape, having a base portion that is greater in width than an opposing apex portion. The conically-shaped macerating members are suitably arranged, in accordance with the subsequent disclosure, so that the outer surfaces of the conically-shaped macerating members, which bear cutting or macerating elements, are in adjacent position to effect maceration of solids that flow between adjacently positioned conically-shaped macerating members. FIG. 7 illustrates yet another exemplar configuration that may be adopted for providing macerating members 50.

Referring again to FIG. 4, the submersible solids processing arrangement 14 may further include a support frame 60 which provides support for the macerating members 50. The support frame 60 may provide a connection point 62 for attachment of an inlet pathway 40 or conduit 47 to the submersible solids processing arrangement 14, and may also supply support for the pump 12 when the pump 12 is connected in proximity to the solids processing arrangement 14 as shown in FIGS. 1 and 2. In one exemplar embodiment, the support frame 60 comprises a first platform 64 and a second platform 66 that is oriented parallel to the first platform 64 and spaced apart from the first platform 64. The spaced relationship of the first platform 64 and second platform 66 may be maintained by a plurality of spacers 68 that span between the first platform 64 and second platform 66. The second platform 66, in use, may be oriented toward the bottom of the sump, well or body of fluid. Notably, however, the solids processing arrangement 14 can be suspended at any selected depth within a sump, well or body of fluid.

The macerating members 50 may be positioned between the first platform 64 and the second platform 66 such that the central axis 54 of each macerating member 50 extends between the first platform 64 and the second platform 66. Some or all of the macerating members 50 are journalled between the first platform 64 and the second platform 66 so that they rotate about their respective central axis 54 relative to the support frame 60. Thus, some of the macerating members 50 may be stationarily fixed to the support frame 60 while others are able to rotate. Alternatively, all of the macerating members 50 may rotate. The central axis 54 of one or more macerating members 50 may be fixed relative to the center point 52 of the solids processing arrangement 14, while maintaining rotational capability relative to the support frame 60.

Alternatively, one or more macerating members 50 may be radially adjustable relative to the center point 52 of the solids processing arrangement 14. Thus, for example, slots 70 may be formed in the second platform 66 and slots 72 may be formed in the first platform 64 through which a macerating member 50 may be journalled, thereby allowing the macerating member 50 to be adjusted, in a radial direction, and positioned closer to the center point 52 or farther away from the center point 52.

Further, in some aspects of the disclosure, one or more macerating members 50 may be axially adjustable relative to the first platform 64 and the second platform 66, which may be particularly advantageous for providing adjustment of the macerating members 50 to accommodate or provide different macerating capabilities when processing different types or sizes of solids (i.e., to provide selected spacing between cutting elements or macerating elements on adjacent macerating members, as described more fully hereinafter).

In any given construction of the solids processing arrangement 14, the macerating members 50 are connected to the support frame 60 in a manner that allows each macerating member 50 to be removed from the support frame 60, independently of any other macerating member, for repair or replacement.

The adjustable positioning of the movable macerating members 50 relative to the support frame 60 may be performed prior to the positioning of the submersible solids processing arrangement 10 in a sump or body of fluid. Alternatively, radial adjustment of the macerating members 50 may be accomplished by associating a hydraulic or pneumatic device with the movable macerating members 50 to effect radial movement of the macerating members 50 once the submersible solids processing arrangement 10 is positioned in a body of fluid, and in response to pumping conditions that develop once the arrangement 10 is positioned in a body of fluid.

In one particular embodiment, the macerating members 50 may be numbered and arranged such that every other macerating member in the arrangement of macerating members, defining a first group of macerating members, is radially adjustable, and every alternate macerating member, positioned adjacent to movable macerating members and defining a second group, is stationary. Thus, for example, in an array of six macerating members 50, every other macerating member 50 in the array, which defines a first group, is radially movable and has a stationary macerating member 50 positioned between two radially movable macerating members 50, the alternating stationary macerating members defining a second group. The adjustability of the macerating members relative to each other provides selective and enhanced maceration of solids responsive to the amount and/or type of solids that are encountered in a given body of fluid.

Each macerating member 50 may be connected to a drive device 74 which imparts rotation, and/or axial or radial movement, to the macerating member 50 to which it is attached. The drive devices 74 may, in one embodiment, be hydraulic motors that are monitored and controlled remotely (i.e., from a point outside of the sump or body of fluid). Other types of motor devices may be equally suitable, however, such as pneumatic motors. As a further example, a gear system may be provided which operates to rotate some or all of the macerating members 50, thereby eliminating the need for individual motor devices dedicated to each macerating member 50.

The drive devices 74 are, most suitably, capable of providing variable speeds of rotation to the macerating members. Further, the drive devices 74 are each, most suitably, capable of reversing the direction of rotation of the macerating member 50 to which it is associated. The reversal of direction of rotation of the macerating member 50 may be accomplished by monitoring and control means, and/or may be automatically initiated by, for example, the encountering by adjacently positioned macerating members of a large solid that becomes lodged between macerating members. The ability of the drive device 74 to automatically or selectively effect a reversal of rotational direction in the macerating member 50 allows lodged solids and debris to be dislodged.

The direction of rotation of each of the macerating members 50 in an array can be selected. Thus, for example, some of the macerating members 50, i.e., a first group, may be held stationary while adjacent macerating members 50, defining a second group, are caused to rotate. More specifically, every other macerating member 50 in an array may be caused to rotate while macerating members positioned between rotating macerating members are held stationary. Alternatively, all macerating members 50 may be caused to rotate in the same direction of rotation. Alternatively, every other macerating member in an array (i.e., a first group) may be caused to rotate in one direction, while every other macerating member (i.e., a second group) is caused to rotate in an opposite direction of rotation. Any number of rotational arrangements of macerating members 50 is possible to suit the conditions of the pumping process.

Additionally, the rotational speed of each of the macerating members 50 can be individually selected suitable to the solids processing conditions. Thus for example, all of the macerating members can be caused to rotate at the same rotational speed. Alternatively, certain numbers of the macerating members (e.g., a first group) may be caused to rotate at a greater rotational speed than other macerating members (e.g., a second group). In one particular embodiment, every other macerating member in an array (i.e., a first group) may be caused to rotate at greater speed than every other alternating macerating member (i.e., a second group). In addition to the selection of the same or variable speeds of rotation of the macerating members, the direction of rotation of the macerating members may be selected to provide varying solids-processing conditions. The ability to vary the speed of the macerating members aids in keeping the macerating members free of solids and debris.

The drive devices 74 are, most suitably, monitored remotely and in real time so that when a slowing of a drive device 74 is perceived, the motor will react, or be made to react, appropriately to reverse direction and/or change speed so that solids or debris that may be lodged between macerating members 50 can be dislodged.

Referring again to the embodiment depicted in FIGS. 1 and 2, the solids processing arrangement 14 is structured with a plurality of macerating members 50 that are positioned around the center point 52 of the submersible solids processing arrangement 14, and in proximity to the suction inlet 18 of the pump 12. As illustrated, the macerating members 50 may be positioned to surround the suction inlet 18. The macerating members 50 may generally be configured as cylindrically-shaped drums 56 having a selected diameter. Each of the macerating members 50 is further configured with a plurality of macerating elements 78 that extend outwardly from the outer surface 58 of the macerating member 50. The macerating elements 78 in this particular embodiment are shown as being arranged in longitudinal rows 80 that extend the length of the cylindrical drums of the macerating members 50. However, the number and spatial arrangement of the macerating elements 78 on the macerating members 50 may vary.

The macerating elements 78 may be formed with edges 82 that, in some embodiments, may be blunt for tearing the solid matter or, in other embodiments, may be sharp for cutting or slicing the solid matter. The macerating members 50 may be configured with a mixture of macerating elements 78, some of which are structured with blunt edges and some of which are structured with sharp edges, or the macerating elements 78 may be of one similar type or construction.

In one particular arrangement, the macerating elements 78 may be arranged on adjacently positioned macerating members 50 such that the macerating elements 78 mesh together to define a chopping zone 84 therebetween, as best seen in FIG. 2. The intermeshing of the macerating elements 78, therefore, cause a maceration of the solids as they pass between adjacently positioned macerating members 50. The macerating elements 78 may be adjustable or movable relative to the outer surface 58 of the macerating member 50, and, for example, may be axially adjustable or movable relative to the length of the macerating member 50. The macerating elements 78 may also be radially adjustable relative to the outer surface 58 of the macerating member 50 and relative to the central axis 54 of the macerating member 50.

In the embodiment of FIGS. 1 and 2, the support frame 60 provides support for both the pump 12 and the solids processing arrangement 14. The macerating members 50 may, in this embodiment, be journalled between the first platform 64 and the second platform 66 by means of a lower rod 86, as best seen in FIG. 2, that extends from the macerating member 50 into a bearing 88 formed in the second platform 66, and by a drive stud 90 that extends from a drive device 74 positioned above the first platform 64, the drive stud 90 extending through the first platform 66 and into a stud well 92 formed in the macerating member 50.

The macerating members 50 are each journalled to rotate about a central axis 54 of the macerating member 50, which, in this embodiment, is parallel to the rotational axis 94 of the impeller 30. The macerating members 50 may, in the alternative, be journalled to rotate about an eccentric axis that is oriented parallel to the rotational axis 94 of the impeller 30. In yet a further embodiment, the macerating members 50 may rotate about the center point 52, which may be oriented at an angle to the rotational axis 94 of the impeller, or is oriented normal to the rotational axis 94 of the impeller.

As further shown in FIG. 2, the support frame 60 is connected to an upstanding collar 96 that is co-axially positioned relative to the rotational axis 94 of the impeller 30. The upstanding collar 96 has an interior configuration which, as seen in cross section in FIG. 2, provides a first cylindrical section 98 that is positioned adjacent to and extends downwardly from the suction inlet 18 of the pump 12, and provides a second, frustoconically-shaped section 100 that extends downwardly and away from the first cylindrical section 98 flaring outwardly in the direction of the second platform 66 of the support frame 60. The plurality of macerating members 50 are arranged about the outer circumference of the lower edge 102 of the second, frustoconically-shaped section 100 and provide a central columnar space 104 below the second, frustoconically-shaped section 100 into which fluid and solids flow for direction toward the inlet 18 of the pump 12.

As shown in FIG. 1, the pump 12 is secured to the support frame 60 by means of stabilizers in the form of stabilizing support columns 106 that are secured to the bearing housing 34, by radially-extending beams 108, and which are further secured to the first platform 64 of the support frame 60. Lifting eyes 110 are formed in the bearing housing 34 to which cables (not shown) are attached for lowering and raising the pump and submersible solids processing arrangement 10 into a well, sump or body of fluid.

Figure 9:
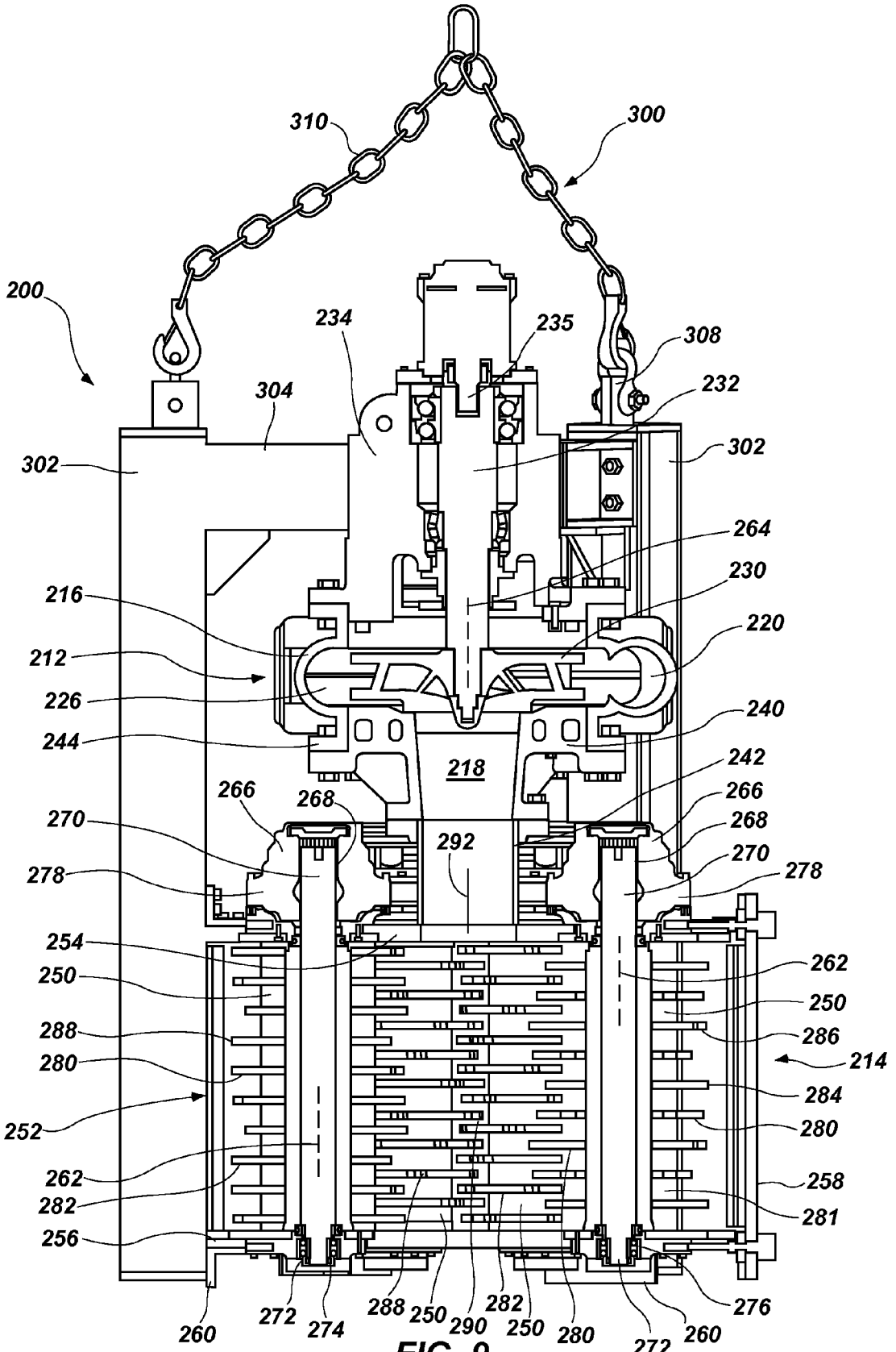
FIG. 9 is a view in elevation and in partial cross section of the pump and submersible solids processing arrangement shown in FIG. 8.

In an alternative aspect of construction of a submersible pump and solids processing assembly that is illustrated in FIGS. 8 and 9, the pump and submersible solids processing assembly 200 comprises a submersible pump 212 and a solids processing arrangement 214. In a similar manner as previously described, and as best viewed in FIG. 8, the submersible pump 212 may generally be comprised of a pump casing 216 having a suction inlet 218 and a discharge outlet 220. As shown in FIG. 8, the discharge outlet 220 is configured to receive additional piping 222 oriented for carrying the pumped fluid to a higher elevation above the bottom of the sump or body of fluid. The pump casing 216 is configured with a volute 226 in which is positioned an impeller 230, which is attached to a pump shaft 232 for rotation. The pump shaft 232 extends through a bearing housing 234 that is attached to the pump casing 216.

As seen in FIG. 9, a throatbush 240 is attached to the pump casing 216 thereby forming the suction inlet 218 of the pump 212. An inlet sleeve 242, as described further below, is positioned adjacent to the throatbush 240 and provides an extended inlet pathway for movement of fluid and solids from the solids processing arrangement 214 toward the impeller 230.

The solids processing arrangement 214 is positioned adjacent to the suction inlet 218 of the pump casing, or the throatbush 240, to direct fluid and solids into the suction inlet 218. The solids processing arrangement 214 of this embodiment generally comprises a plurality of processing or macerating members 250 which, as depicted in FIGS. 8 and 9, may be cylindrically-shaped elements having a selected height and diameter.

The solids processing arrangement 214 further comprises a support frame 252 having an upper plate 254 and a lower plate 256 that is spaced apart from the upper plate 254. The support frame 252 may also comprise spacers or locating elements 258 that extend between the upper plate 254 and the lower plate 256, and secure to the upper plate 254 and lower plate 256 to provide added stability to the support frame 252. The locating elements 258, in addition, may provide feet 260 which operate to position the support frame 252, and particularly the lower plate 256 of the support frame 252, above the bottom or floor of a sump or pit into which the pump and submersible solids processing assembly 200 is lowered, thereby providing a pathway for fluid to move from the bottom of the sump or pit toward the solids processing arrangement 214. It is not necessary, however, for the submersible solids processing arrangement 214 to be positioned at the bottom of a sump or body of fluid since it may be positioned at any desired depth.

The macerating members 250 are generally positioned between the upper plate 254 and lower plate 256 of the support frame 252. Most suitably, the macerating members 250 are journalled between the upper plate 254 and the lower plate 256 such that each macerating member 250 rotates about a central axis 262 thereof. The central axis 262 of each macerating member 250 may generally be parallel, or substantially parallel, to the rotational axis 264 of the impeller 230. In alternative embodiments, the central axis 262 of the macerating members 250 may be oriented at an angle to the rotational axis 264 of the impeller 230, or even oriented in a direction normal to the rotational axis 264 of the impeller 230.

The support frame 252 may further include a bearing element 266 that is positioned adjacent the upper plate 254 of the support frame 252, the bearing element 266 providing a bearing opening 268 sized to receive a center post 270 of the macerating member 250. The bearing element 266 may comprise a plurality of bearing elements 266 that are individually secured to the upper plate 254 of the support frame 252, or the bearing element 266 may be a single array, or ring-like element, that is attached to the upper plate 254 and which is formed with a number of bearing openings 268 as described. The bearing element 266, in either construction, is positioned to encircle the inlet sleeve 242, and may further operate to secure the inlet sleeve 242 in position between the throatbush 240 and the upper plate 254 of the support frame 252.

Each macerating member 250 is also journalled in the lower plate 256 by a central pin 272 that is borne in an opening 274 in the lower plate 256. Bearings 276 may be provided in the openings 274 to facilitate rotation of the central pin 272 therein. In this construction, the macerating members 250 may rotate freely under suction pressure induced by the suction inlet of the pump. Alternatively, the macerating members 250 may be provided with a drive device 278 associated with the bearing element 266, or with the lower plate 256, which impart rotation to the macerating members 250.

In the embodiment depicted in FIGS. 8 and 9, the macerating members 250 include macerating elements 280 that extend outwardly from the outer surface 281 of the cylindrical form of the macerating members 250. The macerating elements 280, in this embodiment, are provided in the form of continuous rings 282 that encircle the circumference of the cylindrical form of the macerating member 250. Notably, while shown as continuous rings 282, the rings may be formed with discontinuities about the circumference of the macerating member 250 while still maintaining a substantially complete, ring-like encirclement of the circumference of the macerating member 250.

A plurality of macerating elements 280 is located about the length of each macerating member 250 and each macerating element 280 is spaced apart from adjacently positioned macerating elements 280 on the same macerating member 250. Consequently, and as best appreciated in FIG. 4, the macerating elements 280 positioned about the circumference of one macerating member 250 are spaced in offset arrangement from the macerating elements 280 positioned about the circumference of an adjacent macerating member 250 such that the macerating elements 280 on adjacently positioned macerating members 250 intermesh with each other.

The macerating elements 280 may be formed with an outer circumferential edge that is circumferentially even (i.e., the distance measured from the outer surface 281 of the macerating member 250 to the outer circumferential perimeter edge of the macerating element 280 is consistent about the circumference of the macerating element 250), and the circumferential edge may be formed with any manner of edging, such as beveling, that provides a sharp edge for cutting or tearing.

Alternatively, as illustrated in FIGS. 8 and 9, the macerating elements 280 may be configured with an outer circumferential perimeter edge 284 in which cutting elements, such as teeth 286, are formed to facilitate maceration or cutting of solid material that enters into the solids processing arrangement 214. The macerating elements 280 on any given macerating member 250 may be varied between those having an even peripheral edge and those having an arrangement of teeth 286.

As depicted further in FIG. 9, the outer circumferential measure of each macerating element 280 may vary, thereby providing a longitudinal offset arrangement between adjacent macerating elements 280 of adjacently positioned macerating members 250. The variance in circumferential measure may arise, in one aspect, from the variation in circumference provided by forming cutting elements 288, or teeth 286, in the macerating elements 280. Any number of variations of size, circumferential dimension or configuration of the macerating elements 280 may be employed in the solids processing arrangement 214. It is only important that the arrangement of macerating members 250 and macerating elements 280 provide or define a processing zone 290 between adjacent macerating members 250 within which solids that are entrained in the pumping fluid can be processed to smaller sizes and directed into the inlet sleeve 242 and suction inlet 218 for delivery to the impeller 230.

The macerating elements 280 may, in one aspect, be securely fixed relative to the outer surface 281 of the macerating members 250. In an alternative aspect, the macerating elements 280 may be axially adjustable along and relative to the axial length, or relative to the center axis 262, of the macerating member 250. Consequently, the macerating elements 280 may be "fine-tuned" to provide a selected type or degree of maceration dictated by the type of solids being processed. Additionally, the macerating elements 280 may be radially adjustable relative to the central axis 262 of the macerating member 250 to also provide a selected type or degree of maceration by varying the distance of the cutting elements 288 at the circumferential periphery or perimeter of the macerating elements 280 relative to the outer surface 281 of the macerating member 250.

The embodiment of the pump and submersible solids processing assembly 200 illustrated in FIGS. 8 and 9 may also include a lifting frame 300 comprising lateral beams 302, here shown to be three in number, each of which is secured to the bearing housing 234 by radial beams 304 and is secured to the support frame 252. The lifting frame 300 includes lifting apparatus 308 to which chains 310 may be connected from lifting the pump and submersible solids processing assembly 200 out of a sump or pit.

Figure 11:
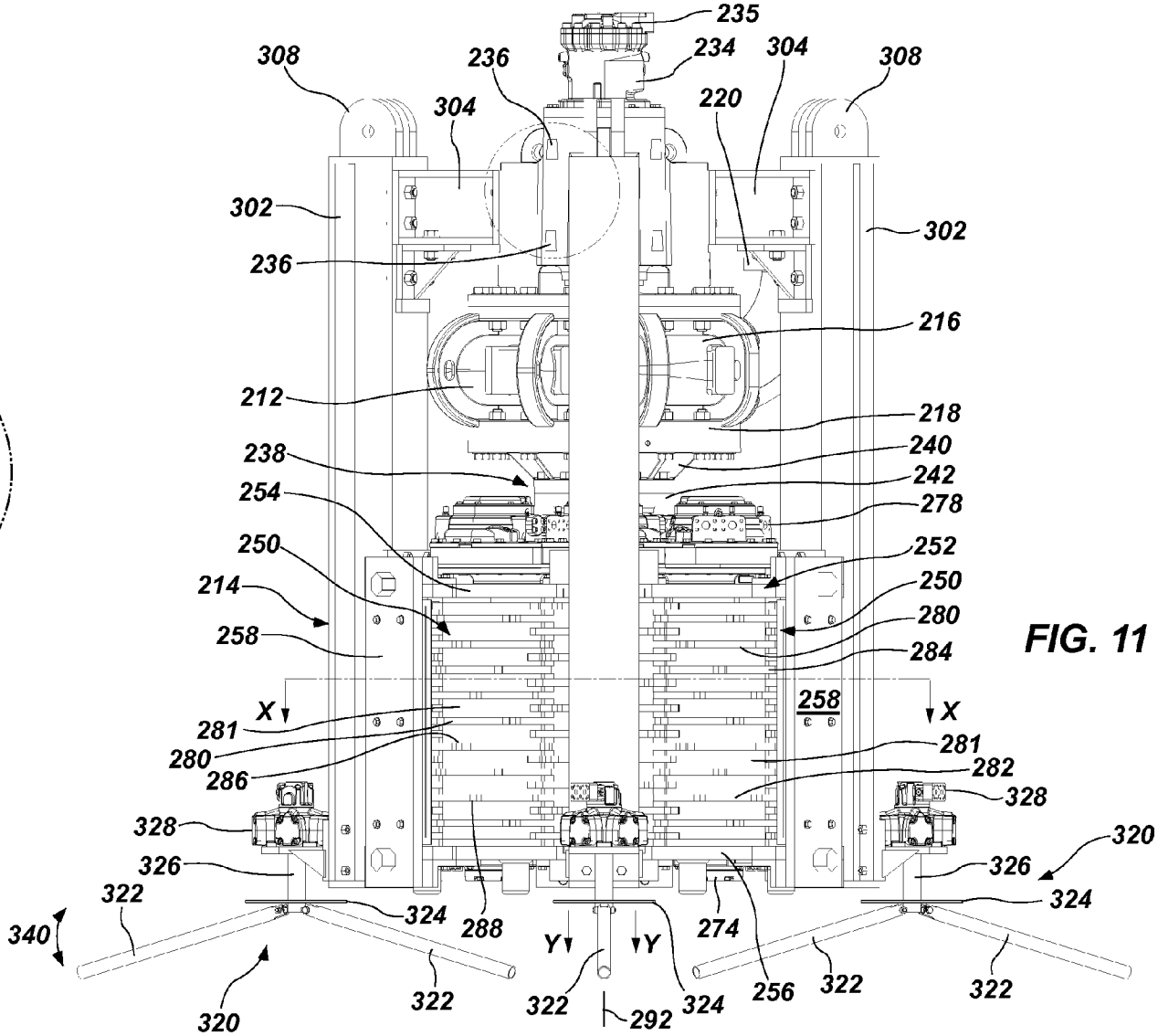
FIG. 11 is a view in elevation of the pump and submersible solids processing arrangement shown in FIG. 10.
Figure 12:
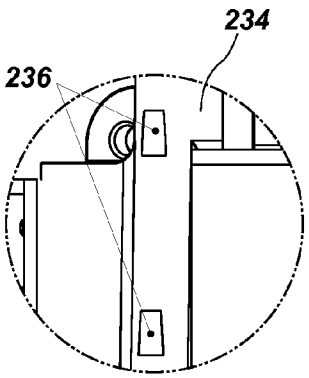
FIG. 12 is an enlarged view of a portion of the bearing housing noted in FIG. 11.

FIGS. 10-17 illustrate yet another aspect of the pump and submersible solids processing assembly 200 of the disclosure where like or similar elements previously described with respect to the embodiment shown in FIGS. 8 and 9 are referred to by the same reference numerals. The pump and submersible solids processing assembly 200 of this aspect comprises a submersible pump 212 that is connected to a submersible solids processing arrangement 214. The pump 212 comprises a casing 216 having an inlet 218 and a discharge outlet 220, and is structured with a volute 226 within which an impeller 230 is positioned. The impeller is attached to a pump shaft 232 that extends through a bearing housing 234. Notably, as shown in FIG. 12, the bearing housing 234 may have vibration flats 236 fitted on the outer surface of the bearing housing 234, the function of which is provide means for attaching vibration sensors (not shown) to the bearing housing 234.

The pump and submersible solids processing arrangement 200 further includes a solids processing arrangement 214 that is positioned in proximity to the suction inlet 218 of the pump 212. The solids processing arrangement 214 is positioned to encounter the flow of fluid and solids as they move toward the suction inlet 218 of the pump 212, and is structured to macerate the solids content of the fluid to effectively reduce the size of the solids so that the solids can be passed through the impeller 230 and volute 226 of the pump 212 without becoming lodged in the pump structures.

Figure 14:
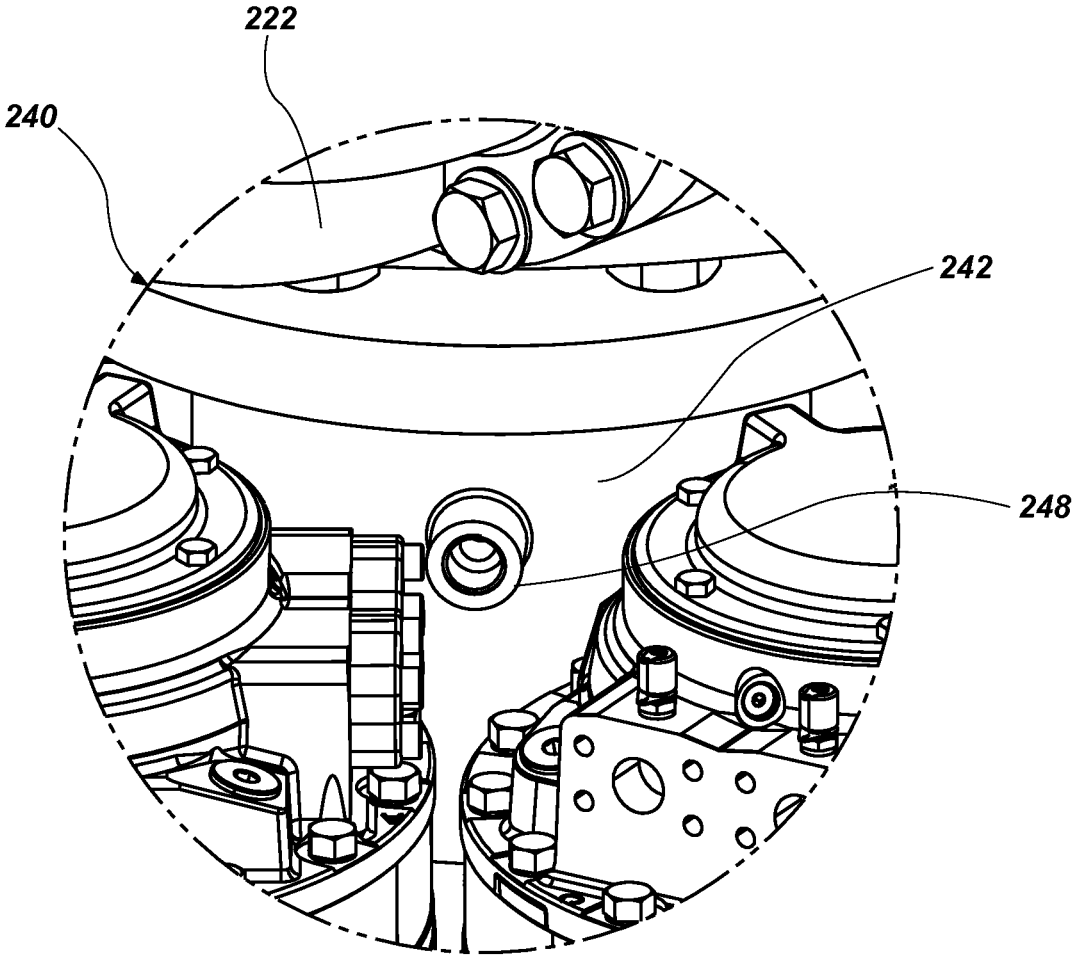
FIG. 14 is an enlarged view of the inlet pathway shown in FIG. 10.
Figure 15:
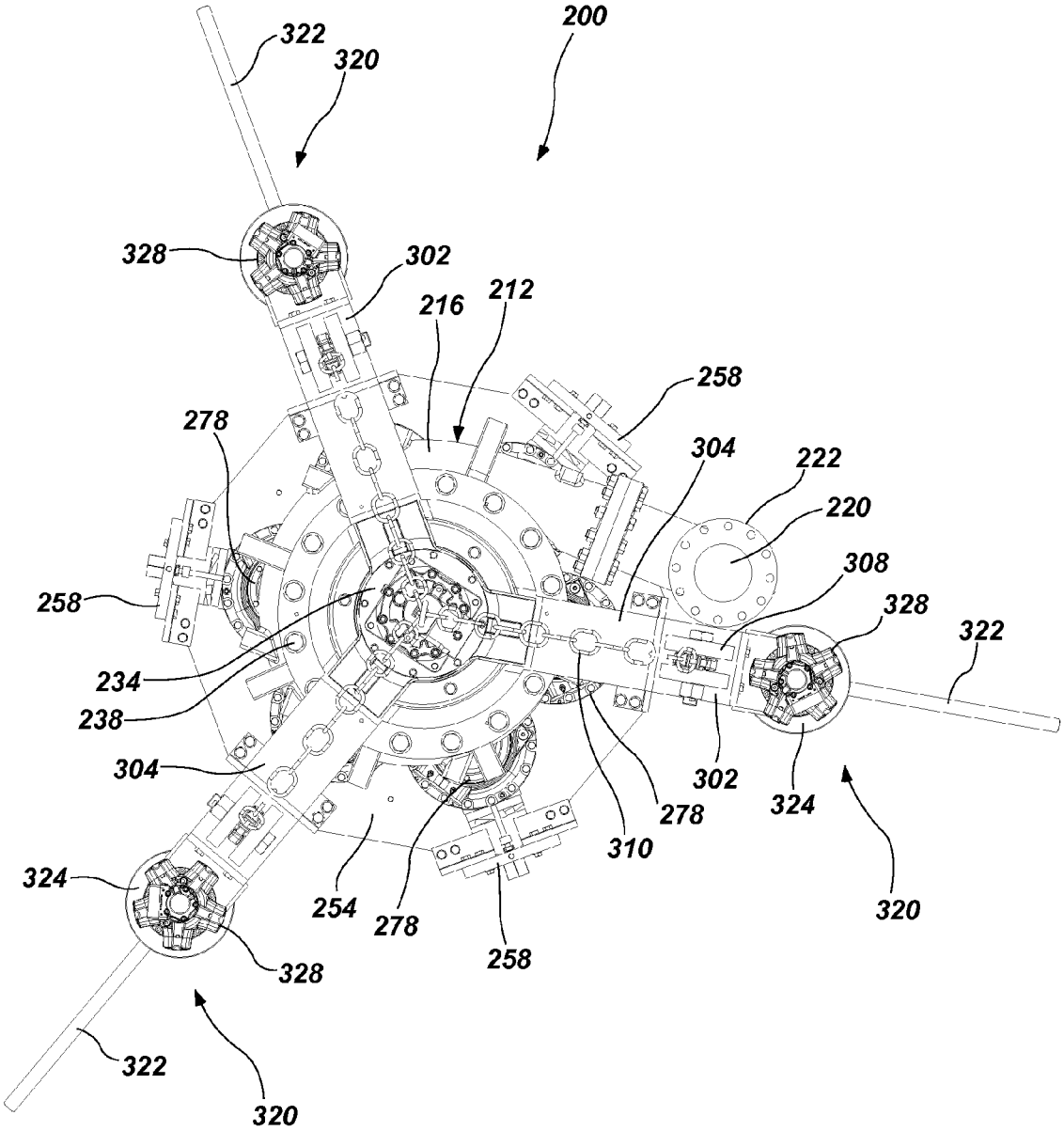
FIG. 15 is a plan view of the pump and submersible solids processing arrangement shown in FIG. 13, taken at line W-W.

The pump 212 is attached to the solids processing arrangement 214 by means of an inlet pathway 238 comprising a throatbush 240 that attaches to the suction flange 244 of the pump 212 to provide a suction head, and an inlet sleeve 242 which is secured to the throatbush 240 by securement means, such as bolts. As depicted in FIGS. 10 and 14, the inlet sleeve 242 may be structured with port elements 248 into which sensor devices may be ported to monitor the fluid dynamics of the fluid and solids entering from the solids processing arrangement 214 into the suction inlet 218 of the pump, defined by the throatbush 240, thereby enabling the monitoring and adjustment of the elements of the pump and submersible solids processing arrangement 214.

Figure 16:
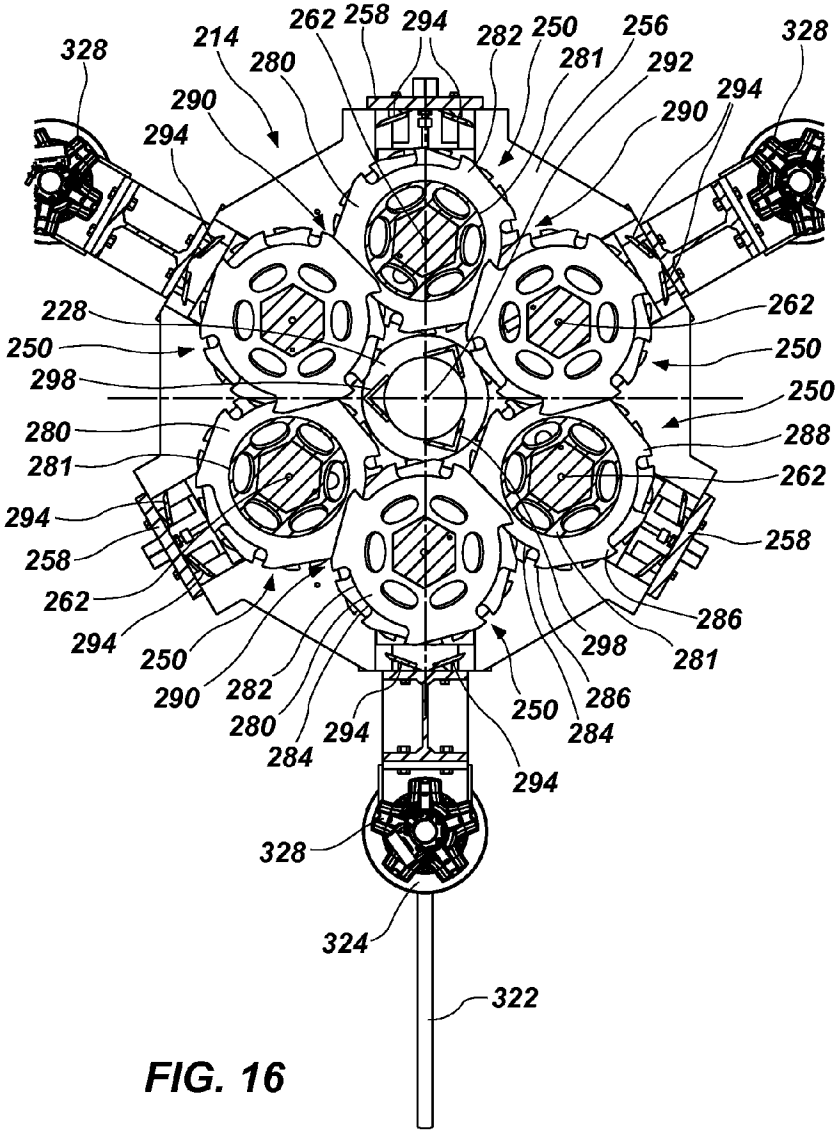
FIG. 16 is an axial cross section view of the submersible solids processing arrangement shown in FIG. 11, taken at line X-X.

The submersible solids processing arrangement 214 of this aspect is further structured with at least one vertically-oriented blade 294 that is positioned adjacent the arrangement of macerating members 250 and which is spaced away from the center point 292 of the submersible solids processing arrangement 214. For example, vertically-oriented blades 294, as seen in FIGS. 10 and 16, may be secured to the spacers or locating elements 258 along a surface 296 of the locating element 258 that is oriented toward the center point 292 of the submersible solids processing arrangement 214. Consequently, the vertically-oriented blades 294 are positioned in proximity to the macerating member 250 so that any material lodged between the locating elements 258 and the adjacent macerating member 250 may be macerated. Vertically-oriented blades 294 may be provided on other structural elements of the solids processing arrangement 214, such as the lifting frame 300, as shown in FIG. 10. Breaker bars 298, as seen in FIG. 16, may also be positioned about the center point 292 and in proximity to the macerating member 250 to provide further maceration of any solids that may become lodged between the macerating members 250 near the center point 292 of the solids processing arrangement 214.

The solids processing arrangement 14 may further include at least one agitator arrangement 320 positioned adjacent to the solids processing arrangement 214 in proximity to the macerating members 250. As illustrated in FIGS. 10 and 11, the agitator arrangement 320 may be positioned at an elevation below the submersible solids processing arrangement 214. However, the agitator arrangement 320 may be positioned in any suitable proximity or position relative to the solids processing arrangement 214 which will facilitate the agitation and movement of fluid and solids toward the macerating members 250.

The agitator arrangement 320 may comprise, in one embodiment, at least one arm 322 which extends radially outwardly from a support plate 324. The support plate 324 is connected to a rotating shaft 326, which is operatively connected to a drive means 328 that imparts rotation to the rotating shaft 326, and likewise to the support plate 324 and arms 322. The axis of rotation of the arrangement of arms may be parallel to the center point 292 of the submersible solids processing arrangement 214, but may, in the alternative, be non-parallel to the center point 292 of the submersible solids processing arrangement 214.

The drive means 328 may be any suitable device which can impart rotation to the arm or arms 322 of the agitator arrangement 320, but may, most suitably, be a hydraulic motor. The hydraulic motor may be remotely monitored and controlled to allow the rotation of the arms to be increased, decreased or stopped. In certain embodiments, the support drive means 328 may be secured to and supported by the lower portion of the lateral beam 302.

Figure 13:
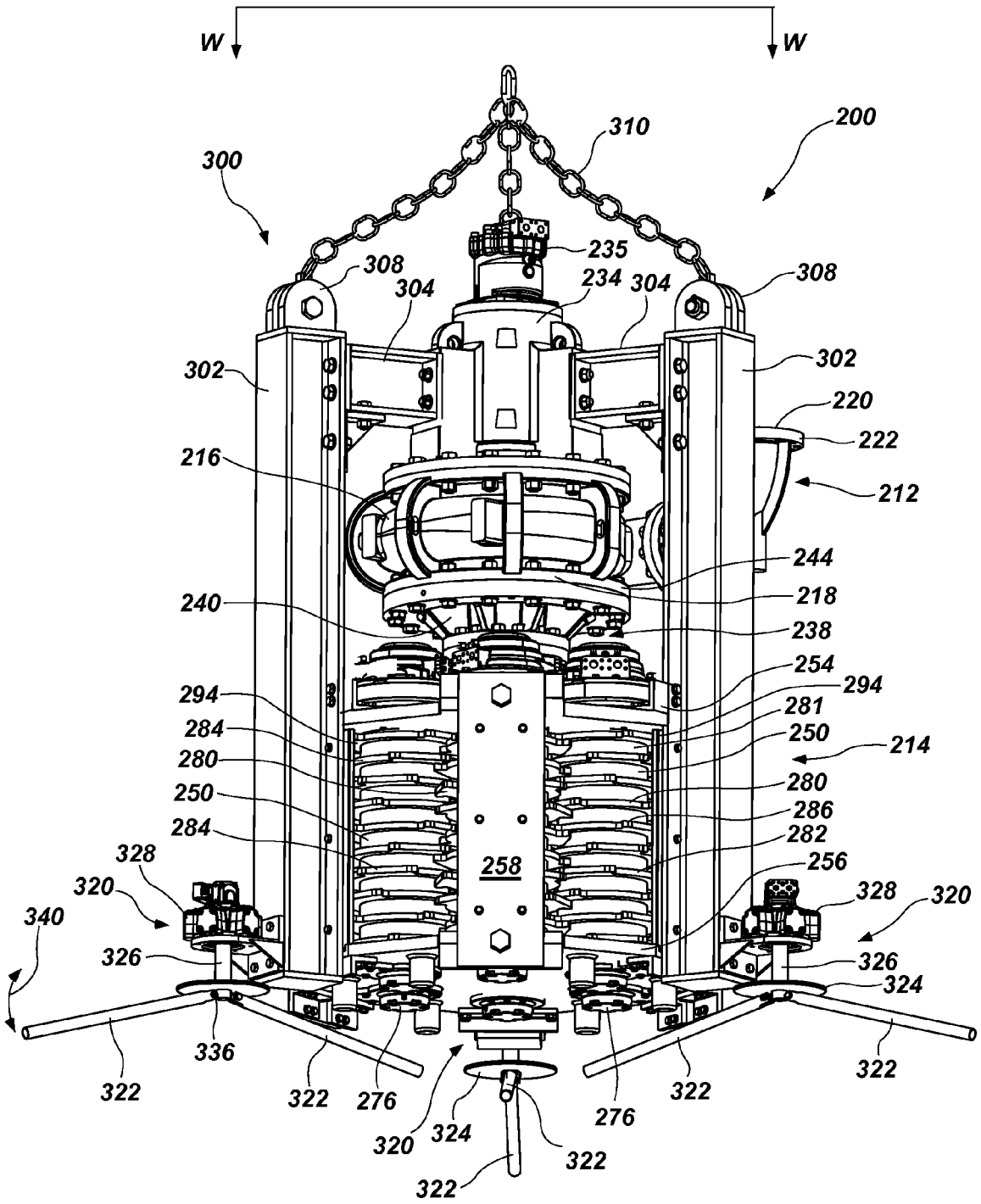
FIG. 13 is an isometric perspective view of the pump and submersible solids processing arrangement illustrating the lower portion of the submersible solids processing arrangement.
Figure 17:
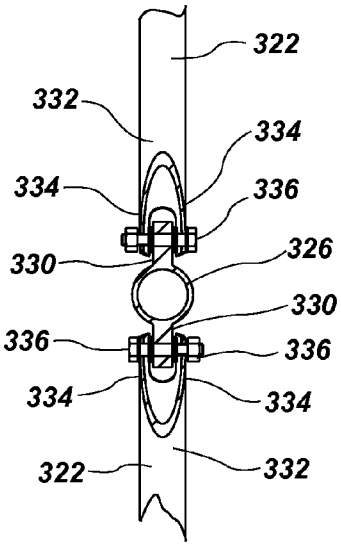
FIG. 17 is a plan view of an agitator arm taken at line Y-Y of FIG. 11.

The agitator arrangement 320 may have one or more arms 322 that are connected to the support plate 324 in a manner that allows the arms 322 to move relative to the support plate 324. Thus, as seen in FIGS. 11, 13 and 17, the rotating shaft 326 may, in one embodiment, extend through the support plate 324, and may be configured with outwardly extending tabs 330. The inward end 332 of each arm 322 is structured with opposing ears 334 that straddle the outwardly extending tab 330, and are pivotally secured to the tab 330 by a pivot pin 336. As constructed, each arm 322 is able to move upwardly and downwardly, as denoted by the arrow 340 (FIG. 11), in a vertical plane that extends parallel to a plane in which a longitudinal line or axis defining the center point 292 lies.

The rotational speed of the agitator arrangement 320 may be varied depending on the conditions and material that is being pumped. The rotation of the agitator arms 322 is beneficial in providing shearing actions of solids in the fluid, and promotes motion of the fluid which facilitates the drawing in of fluid by the submersible solids processing arrangement 214. To that end, the arms 322 may be constructed with edges that are sharpened to facilitate shearing of material, and may be configured with cutting elements. The position and inclusion of an agitator arrangement 320 also facilitates the avoidance of cavitation in the pump by enhancing flow of solids and fluid.

Agitation of the fluid and solids in the body of fluid may be accomplished by other means. For example, rather than providing an arrangement of arms 322 as described, the agitation arrangement may employ rotational screw or spiral-like devices that are rotatable to cause a stirring up and/or shearing of solids prior to entry into the submersible solids processing arrangement 214. Alternatively, one or more sparger units 360 (FIG. 10) may be positioned near the lower portion or lower plate 256 of the submersible solids processing arrangement 214. The submersible solids processing arrangement 214 may be structured with both sparger 360 apparatus and an agitator arm arrangements. Other apparatus may provide equivalent agitation of the fluid and solids.

Figure 18:
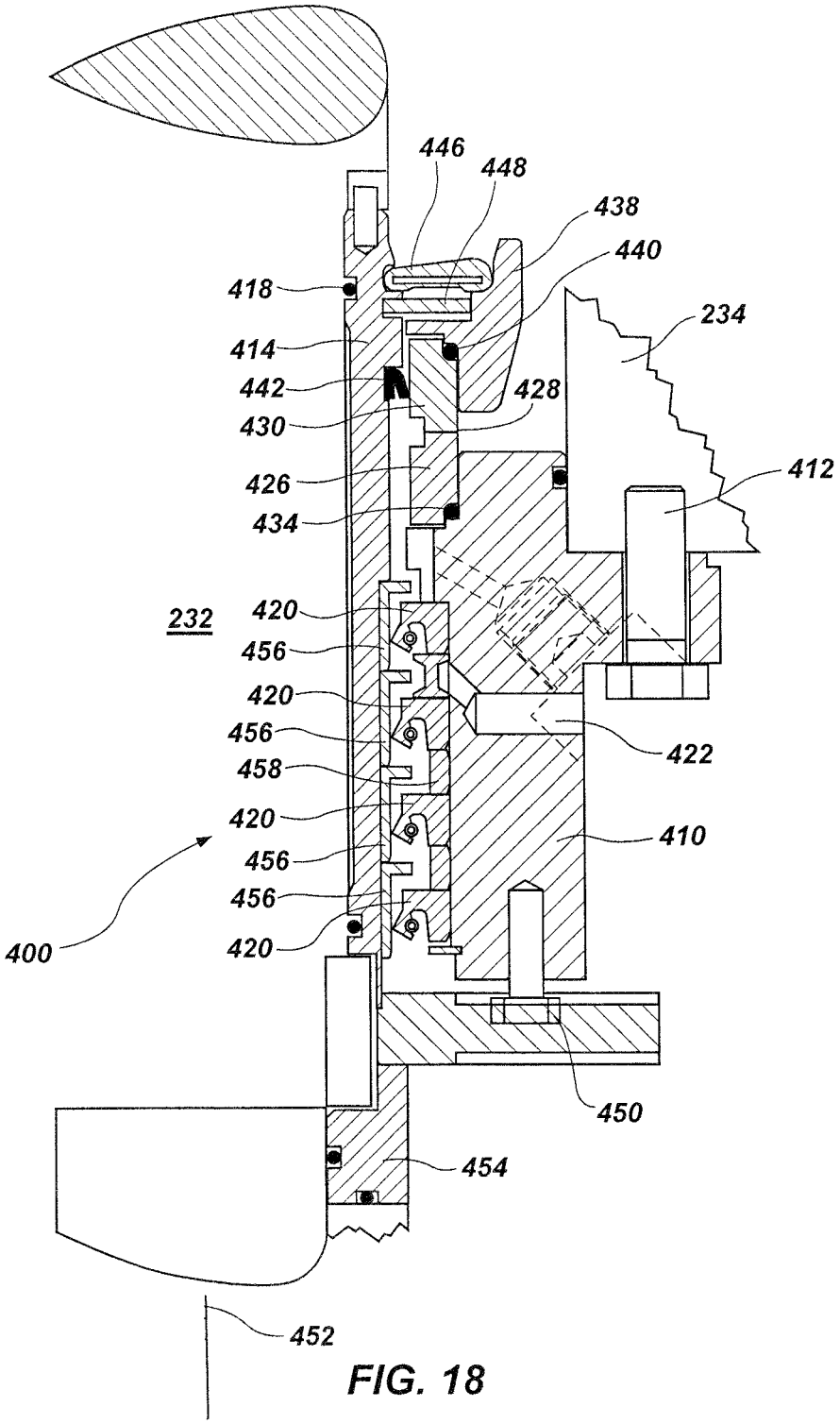
FIG. 18 is a view in radial cross section of a portion of the bearing housing of the pump and submersible solids processing arrangement depicting a cartridge seal arrangement.
Figure 19:
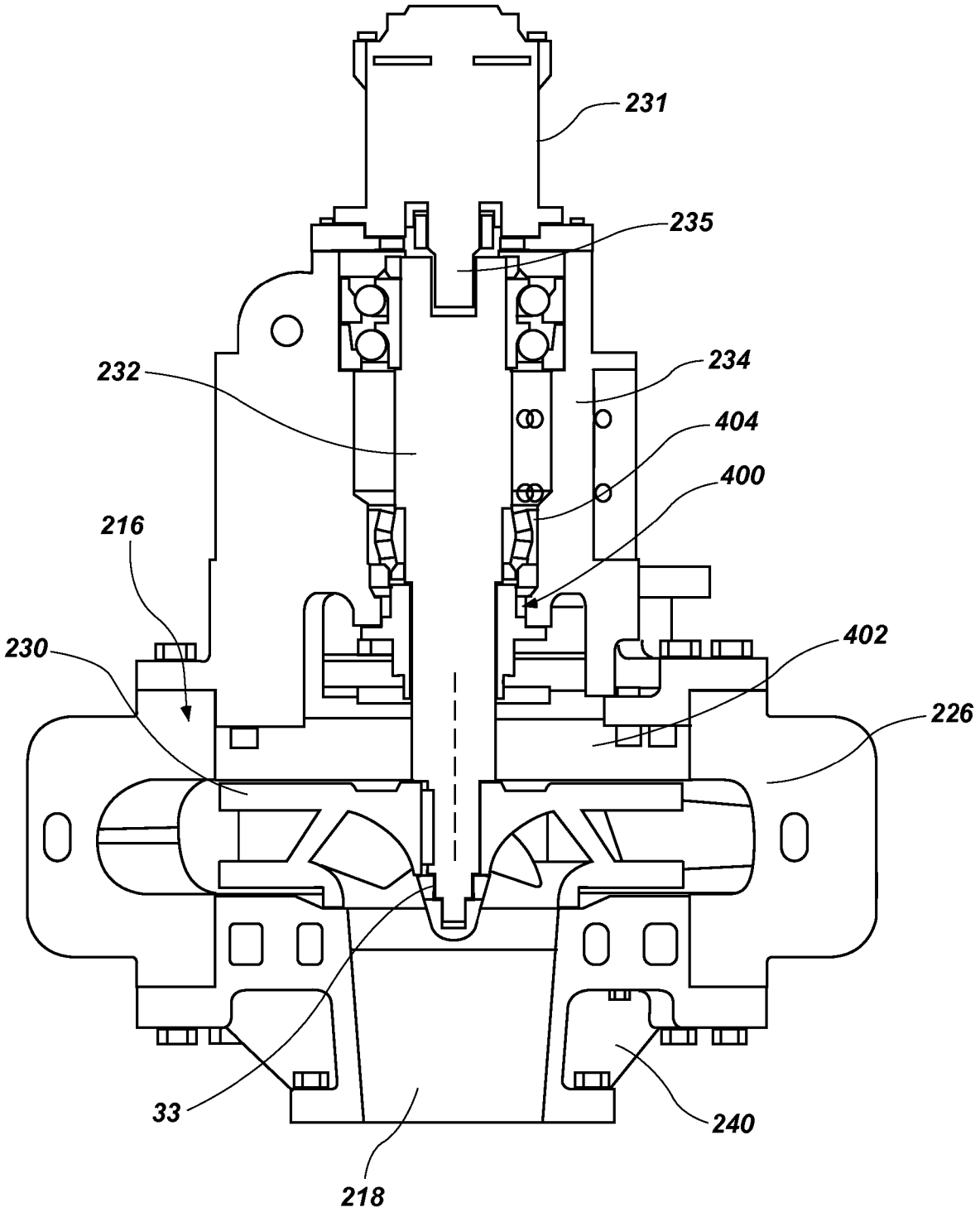
FIG. 19 is a view in radial cross section of a pump illustrating the relative positioning of the cartridge seal arrangement in the pump.

The pump and submersible solids processing arrangements 10 and 200 described herein may also be structured with a seal cartridge 400, as shown in FIGS. 18 and 19, which effectively seals the pump shaft 232 from the pump casing 216. As shown in FIG. 19, the seal cartridge 400 is positioned about the pump shaft 232, and extends from proximate a back or frame plate 402 of the pump casing 216 to proximate an inboard set of bearings 404.

As shown in FIG. 18, which depicts a portion of the seal cartridge 400 in position about the pump shaft 232, the seal cartridge 400 generally comprises a cylindrical gland housing 410 that surrounds the pump shaft 232. The gland housing 410 is structured to be connected to the bearing housing 234 by securement means, such as bolts 412. The gland housing 410 is further structured to be connected to and supported by a shaft sleeve 414. The shaft sleeve 414 surrounds the pump shaft 232 and is sealed thereagainst by an o-ring 418.

The gland housing 410 is also structured to surround and house a series of lip seals 420 that are arranged and positioned between the gland housing 410 and the shaft sleeve 414. An external lube port 422 is formed in the gland housing 410 through which a lubricating material, such as grease, may be provided to the lip seals 420. The gland housing 410 further supports a stationary seal 426 that forms a seal face 428 with a rotating seal 430 that surrounds the shaft sleeve 414. The stationary seal 426 is sealed, by an o-ring 434, from the gland housing 410. The rotating seal 430 is held in place by a retaining ring 438, and is sealed from the retaining ring 438 by an o-ring 440. A spring member 442 positions the rotating seal 430 between the shaft sleeve 414 and the retaining ring 438. A Belleville or similar spring 446 and drive key 448 are supported by grooves in the shaft sleeve 414 and maintain the retaining ring 438 in position about the shaft sleeve 414.

A slinger device 450 may be positioned adjacent the gland housing 410, and is operably attached to the pump shaft 232 in a manner that allows the slinger device 450 to rotate about the rotational axis 452 of the pump shaft 232. The slinger device 450 may be held in position by a support ring 454. The rotating slinger device 450 is beneficial in moving fluid and solids away from the shaft sleeve 414 and lip seals 420.

Additionally, each of the lip seals 420 has associated therewith a ring-shaped deflector device 456 which effectively operates to keep fluid and solids from infiltrating into the lip seals 420, each of which is separated further by a spacer ring 458. The seal cartridge 400 of the disclosure is especially effective in protecting the seal face 428 by virtue of the arrangement of series of lip seals 420 and deflectors 456. The arrangement provides a heavy duty seal against infiltration of slurries by providing a serial arrangement of deflectors that keep slurry from infiltrating into the lip seals. Additionally beneficial to the seal cartridge arrangement is the application of increased lubrication pressure in the cartridge that prohibits infiltration of slurry into the lip seals 420.

The operation of the pump and submersible solids processing assembly of the disclosure is described herein with reference to the embodiment shown in FIG. 10; however, the same mode of operation is applicable to the alternative embodiments also described and illustrated herein. In operation, the pump and submersible solids processing arrangement 200 is lowered into a well, sump or body of fluid until the lower plate 254 of the support frame 252 becomes positioned at the desired depth in a body of fluid. The pump 212 is then placed into operation by causing the drive shaft 235 and pump shaft 232 to rotate, thereby causing rotation of the impeller 230. As the impeller 230 rotates with increasing speed, suction pressure is created at the suction inlet 218 which, in turn, causes fluid in the sump or body of fluid to be drawn toward the submersible solids processing arrangement 214 in a direction generally perpendicular, or normal, to the center point 292 of the submersible solids processing arrangement 213 or the rotational axis 264 of the pump 212 and impeller 230.

In one embodiment, suction imposed on the fluid by the rotating impeller causes the macerating members 250, which are journalled within the support frame 252, to rotate as fluid is drawn into the columnar space 228 (FIG. 16) within the support frame 252 and between the arrangement of macerating members 250. The solids entrained in the fluid are drawn through a processing zone 290 (FIG. 3) defined between adjacent macerating members 250 and through the meshing macerating elements 280, thereby being macerated (e.g., chopped, sliced, cut, crushed and/or ground) into smaller pieces of solid matter. The fluid and smaller pieces of solids are then drawn from the columnar space 228 into the inlet pathway 238 (FIG. 11) and then into the impeller 230, from where the fluid is forced into the volute 226 of the pump 212 and out the discharge outlet 220. The rotating action of the agitator arrangements 320 further enhance the direction of fluid into the macerating members 250 as previously described.

In an alternative embodiment, the macerating members 250 may be driven to rotate, such as by applying drive means, such as operatively provided by drive devices 278, to each macerating member 250.

In another aspect, methods for processing and pumping fluid and solids entrained in the fluid comprise:

providing a pump and submersible solids processing arrangement, comprising, a pump having a casing, a suction inlet and a discharge outlet, and a submersible solids processing arrangement positioned in fluid communication with the suction inlet of the pump and being structured to macerate solids entrained in a fluid prior to entry of the fluid into the inlet of the pump;

positioning said pump in a source of fluid having entrained solids;

creating suction at said suction inlet of the pump by operation of the pump, thereby drawing fluid and the entrained solids into the submersible solids processing arrangement positioned in fluid communication with the suction inlet of the submersible pump;

operating said submersible solids processing arrangement to effect maceration of the solids entrained in the fluid as the fluid passes through the submersible solids processing arrangement and into the suction inlet of the pump; and moving the fluid and macerated solids entrained in the fluid through the pump to the discharge outlet of the pump.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the inventions, and alterations, modifications, additions and/or changes can be made thereto without departing from the scope and spirit of the disclosed embodiments, the embodiments being illustrative and not restrictive.

Furthermore, inventions have been described in connection with what are presently considered to be the most practical and preferred embodiments. It is to be understood that the invention is not to be limited to the disclosed embodiments, but to the contrary, is intended to cover various modifications and equivalent arrangements included within the spirit and scope of the inventions. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A submersible apparatus for processing and pumping fluid-entrained solids, comprising:

a pump having a casing, a suction inlet, a discharge outlet and an impeller positioned within the casing, the impeller having a rotational axis;

a drive assembly connected to the impeller for imparting rotation to the impeller;

a support frame having a first platform to which the suction inlet of the pump is secured, the first platform having an opening formed therethrough to which the suction inlet of the pump is aligned for receiving fluid through the opening in the first platform, and the support frame having a second platform positioned parallel to the first platform and spaced apart from the first platform, the support frame including spacers connected between the first platform and the second platform to maintain a space therebetween;

a submersible solids processing arrangement positioned between the first platform and second platform of the support frame, the solids processing arrangement further comprising a plurality of rotatable macerating members that are journalled between the first platform and second platform, each of the macerating members being structured with macerating elements that extend outwardly from an outer surface of each macerating member, whereby the macerating members are arranged to encircle the opening of the first platform of the support frame and are arranged so that the macerating elements mesh with macerating elements of adjacently positioned macerating members to define a pathway for entry of fluid and solids into a flow direction prior to entering into the suction inlet of the pump.

2. The submersible apparatus of claim 1, wherein the pump is located at a distance from the submersible solids processing arrangement, and the pump is in fluid communication with the submersible solids processing arrangement via a length of conduit that is secured at one end to the suction inlet of the pump and secured at the other end to the submersible solids processing arrangement.

3. The submersible apparatus of claim 1, wherein the macerating members are each structured with a central axis, and wherein some or all of the macerating members rotate about their respective central axis.

4. The submersible apparatus of claim 3, wherein certain of the macerating members rotate in a defined direction, and certain of the macerating members rotate in the opposite direction to the defined direction.

5. The submersible apparatus of claim 3, wherein the rotational direction of any macerating member can be selected through drive means attached to each macerating member.

6. The submersible apparatus of claim 3, wherein each macerating member is attached to a drive means, and wherein the direction of rotation of any macerating member can be reversed to cause the macerating member to change in direction of rotation.

7. The submersible apparatus of claim 1, wherein some or all of the macerating members are radially adjustable relative to a center point of the submersible solids processing arrangement so that each radially adjustable macerating member may be adjusted closer to or farther from the center point of the submersible solids processing arrangement.

8. The submersible apparatus of claim 1, wherein some or all of the macerating members are axially adjustable in a direction substantially parallel to a longitudinal axis extending through a center point of the submersible solids processing arrangement.

9. The submersible apparatus of claim 1, wherein each macerating member is structured with a plurality of macerating elements arranged along the macerating member such that macerating elements of one macerating member are arranged to effect a cutting action with macerating elements of an adjacently positioned macerating member.

10. The submersible apparatus of claim 9, wherein each macerating member has a central axis, and the macerating elements of each macerating member are axially adjustable in a direction along the central axis of the macerating member with which the macerating elements are associated.

11. The submersible apparatus of claim 9, wherein each macerating member has a central axis, and the macerating elements are radially adjustable to position the macerating elements closer to or farther from the central axis of the macerating member.

12. The submersible apparatus of claim 1, wherein each macerating member of the plurality of macerating members has a central axis, and the central axis of each macerating member is parallel to a longitudinal line extending through a center point of the submersible solids processing arrangement.

13. The submersible apparatus of claim 1, wherein each macerating member of the plurality of macerating members has a central axis, and the central axis of each macerating member is other than parallel to a longitudinal line extending through a center point of the submersible solids processing arrangement.

14. The submersible apparatus of claim 1, further comprising an agitator arrangement comprising at least one agitator positioned in proximity to the macerating members to direct flow of agitated fluid and solids to the macerating members of the solids processing arrangement.

15. The submersible apparatus of claim 14, wherein the agitator arrangement further comprises an arrangement of arms operatively connected to a motor to impart rotation to the arrangement of arms.

16. The submersible apparatus of claim 14, wherein said agitator arrangement comprises at least one sparger.

17. The submersible apparatus of claim 3, further comprising at least one vertically-oriented blade positioned adjacent the arrangement of macerating members and spaced away from a center point of the submersible solids processing arrangement, the at least one vertically-oriented blade being positioned in proximity to the macerating elements of the macerating members to facilitate removal of solids matter from the macerating members.

18. The submersible apparatus of claim 1, wherein the pump further comprises a bearing housing attached to the pump casing at a point opposite the suction inlet, and a pump shaft which extends through the bearing housing and the pump casing to be operatively connected to an impeller, the pump being further configured with a cartridge seal arrangement surrounding the pump shaft and being positioned between the bearing housing and pump casing to seal the pump shaft from the pump casing, the cartridge seal arrangement comprising a series of lip seals and deflectors positioned adjacent each lip seal, a slinger device and a centrally positioned lubrication port positioned to introduce a lubricant to the series of lip seals.

19. The submersible apparatus of claim 1, wherein the pump is a rotodynamic pump having an impeller and the pump is located at a distance from the submersible solids processing arrangement, the pump being in fluid communication with the submersible solids processing arrangement via a length of conduit that is secured at one end to the inlet of the pump and secured at the other end to the submersible solids processing arrangement.

20. The submersible apparatus of claim 18, wherein the cartridge seal arrangement further comprises:

a rotating seal having a seal face;

a stationary seal having a seal face positioned adjacent to and in contact with the seal face of the rotating seal;

a gland housing configured to surround a pump shaft and positioned to support the stationary seal;

a plurality of lip seals positioned serially within the gland housing; and a plurality of deflectors, one deflector being positioned adjacent each lip seal of said plurality of lip seals.

* * * * *